US008818217B2

(12) United States Patent
Takayanagi

(10) Patent No.: US 8,818,217 B2
(45) Date of Patent: Aug. 26, 2014

(54) IMAGE FORMING APPARATUS WITH CLEANING VOLTAGE OR CURRENT CONTROL BASED ON DENSITY OF A CONTROL TONER IMAGE

(75) Inventor: Hiroki Takayanagi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 156 days.

(21) Appl. No.: 13/246,085

(22) Filed: Sep. 27, 2011

(65) Prior Publication Data

US 2012/0087683 A1 Apr. 12, 2012

(30) Foreign Application Priority Data

Oct. 8, 2010 (JP) ..... 2010-228678

(51) Int. Cl.
*G03G 15/00* (2006.01)

(52) U.S. Cl.
USPC ..... 399/49; 399/101

(58) Field of Classification Search
USPC ..... 399/49, 101, 59
See application file for complete search history.

(56) References Cited

U.S. PATENT DOCUMENTS

| | | | | |
|---|---|---|---|---|
| 5,729,788 | A | 3/1998 | Hirohashi et al. | |
| 5,740,495 | A * | 4/1998 | Maher et al. | 399/71 |
| 6,823,152 | B2 | 11/2004 | Kida | |
| 7,385,737 | B2 | 6/2008 | Zaima | |
| 7,773,907 | B2 | 8/2010 | Takayanagi | |
| 7,949,269 | B2 | 5/2011 | Takeuchi | |
| 2003/0128381 | A1 | 7/2003 | Zaima | |
| 2003/0161652 | A1 | 8/2003 | Nishiwaki | |
| 2005/0141920 | A1 | 6/2005 | Sato et al. | |
| 2005/0207779 | A1 | 9/2005 | Takahashi et al. | |
| 2005/0220478 | A1 | 10/2005 | Ai et al. | |
| 2005/0238382 | A1 | 10/2005 | Takei | |
| 2006/0083538 | A1 | 4/2006 | Terae et al. | |
| 2007/0059007 | A1 | 3/2007 | Ai | |
| 2010/0266309 | A1 | 10/2010 | Takayanagi | |

FOREIGN PATENT DOCUMENTS

| | | | | |
|---|---|---|---|---|
| JP | 4-263279 | A | 9/1992 | |
| JP | 7-281510 | A | 10/1995 | |
| JP | 08137286 | A * | 5/1996 | G03G 15/10 |
| JP | 8-254909 | A | 10/1996 | |
| JP | 8-314297 | A | 11/1996 | |
| JP | 08314297 | A * | 11/1996 | G03G 15/16 |
| JP | 2000-75571 | A | 3/2000 | |
| JP | 2003-084582 | A | 3/2003 | |
| JP | 2006251030 | A * | 9/2006 | |
| JP | 2009-014961 | A | 1/2009 | |

* cited by examiner

*Primary Examiner* — Quana M Grainger
(74) *Attorney, Agent, or Firm* — Fitzpatrick, Cella, Harper & Scinto

(57) ABSTRACT

An image forming apparatus includes an image bearing member that is rotatable, a toner image forming portion that is able to form a toner image to be transferred to a transfer material and a control toner image not to be transferred to a transfer material on the image bearing member, a transfer member that transfers the toner image formed on the image bearing member to the transfer material, a detecting portion that detects a density of the control toner image, an adjustment portion that adjusts a toner image formation condition of the toner image forming portion based on an output of the detecting portion, a cleaning member that electrostatically cleans the transfer member, and a controller which changes a voltage or a current to be applied between the transfer member and the cleaning member based on the density of the control toner image.

9 Claims, 16 Drawing Sheets

| 【REAR SHEET SMEAR】 | PATCH DENSITIES | | | | | |
|---|---|---|---|---|---|---|
| CLEANING CURRENT CONTROLLING METHOD | 0.1 | 0.3 | 0.5 | 0.8 | 1.2 | 1.6 |
| EMBODIMENT | ○ | ○ | ○ | ○ | ○ | ○ |
| FIXED +10 μA | × | × | × | ○ | ○ | ○ |
| FIXED +6 μA | × | ○ | ○ | ○ | × | × |
| FIXED +2 μA | ○ | ○ | × | × | × | × |

| [REAR SHEET SMEAR] | PATCH DENSITIES | | | | | |
|---|---|---|---|---|---|---|
| CLEANING CURRENT CONTROLLING METHOD | 0.1 | 0.3 | 0.5 | 0.8 | 1.2 | 1.6 |
| EMBODIMENT 2 (EMBODIMENT 3) | ○ | ○ | ○ | ○ | ○ | ○ |
| FIXED +10 μA | × | × | × | ○ | ○ | ○ |
| FIXED +6 μA | × | ○ | ○ | ○ | × | × |
| FIXED +4 μA | ○ | ○ | ○ | × | × | × |

FIG. 9B

【REAR SHEET SMEAR】

| CLEANING CURRENT CONTROLLING METHOD | PATCH DENSITIES CASE WHERE TWO PATCHES ARE ARRANGED IN MAIN SCANNING DIRECTION | | | | | |
|---|---|---|---|---|---|---|
| | 0.1 | 0.3 | 0.5 | 0.8 | 1.2 | 1.6 |
| EMBODIMENT 4 | ○ | ○ | ○ | ○ | ○ | ○ |
| FIXED +10 μA (0.8～1.6)<br>FIXED +4 μA (0.1～0.5) | ○ | ○ | × | ○ | ○ | × |
| FIXED +12 μA | × | × | × | × | ○ | ○ |
| FIXED +10 μA | × | × | × | ○ | ○ | × |
| FIXED +6 μA | × | ○ | ○ | × | × | × |
| FIXED +4 μA | ○ | ○ | × | × | × | × |

FIG. 9C

【REAR SHEET SMEAR】

| CLEANING CURRENT CONTROLLING METHOD | PATCH DENSITIES CASE WHERE ONE PATCH IS ARRANGED IN MAIN SCANNING DIRECTION | | | | | |
|---|---|---|---|---|---|---|
| | 0.1 | 0.3 | 0.5 | 0.8 | 1.2 | 1.6 |
| EMBODIMENT 4 | ○ | ○ | ○ | ○ | ○ | ○ |
| FIXED +10 μA | × | × | × | ○ | ○ | ○ |
| FIXED +6 μA | × | ○ | ○ | ○ | × | × |
| FIXED +4 μA | ○ | ○ | ○ | × | × | × |

FIG. 10C

| 【REAR SHEET SMEAR】 | PATCH DENSITIES | | | | | |
|---|---|---|---|---|---|---|
| CLEANING CURRENT CONTROLLING METHOD | 0.1 | 0.3 | 0.5 | 0.8 | 1.2 | 1.6 |
| EMBODIMENT 5 | ○ | ○ | ○ | ○ | ○ | ○ |
| FIXED + 13 μA | × | × | × | ○ | ○ | ○ |
| FIXED +9 μA | × | ○ | ○ | ○ | × | × |
| FIXED +7 μA | ○ | ○ | ○ | × | × | × |

IMAGE FORMING APPARATUS WITH CLEANING VOLTAGE OR CURRENT CONTROL BASED ON DENSITY OF A CONTROL TONER IMAGE

BACKGROUND OF THE INVENTION

1. Field of the Invention

The present invention relates to an image forming apparatus that includes a cleaning portion cleaning an image control toner image.

2. Description of the Related Art

When an image forming apparatus, which obtains an achievement by forming an image on a transfer material, outputs a plurality of same images, it is desirable that the first image to the final image are viewed with the same density and tone. U.S. Pat. No. 7,385,737 discloses an image forming apparatus which meets the requirement. The image forming apparatus disclosed in U.S. Pat. No. 7,385,737 first controls the density correction characteristic of the image forming apparatus based on an image characteristic of an image control toner image formed on a transfer material. Then, the image forming apparatus forms the image control toner image in a region other than an image formation region on a photosensitive drum by the use of an image characteristic of an image control toner image formed on the photosensitive drum as reference information, when forming a normal image, and corrects the density correction characteristic based on a difference between a reference characteristic and the image characteristic of the image control toner image. With such a configuration, it is possible to provide frequently executable image control with less time and effort.

On the other hand, as a known technique, there is known an image forming apparatus that includes an intermediate transfer belt. That is, there is known an image forming apparatus in which an image control toner image is allowed to be attached on the intermediate transfer belt and which includes a cleaning portion cleaning the image control toner image with a fur blush applied with an opposite-polarity bias of the polarity of a toner. It is known that the image forming apparatus of the known technique resolves the following problem with the image forming apparatus disclosed in U.S. Pat. No. 7,385,737. That is, the image forming apparatus disclosed in U.S. Pat. No. 7,385,737 forms the image control toner image at a position corresponding to a gap (gap between sheets) between transfer materials of a plurality of output image regions formed on the intermediate transfer belt, when continuously forming a plurality of images. In this way, the density of the image control toner image is corrected in parallel to formation of the output image. A transfer roller is separated from the intermediate transfer belt in the gap between the transfer materials and a cleaning device collects toner forming the image control toner image together with residual transfer toner so that the toner image on the surface of the intermediate transfer belt is not attached to the transfer material from the intermediate transfer belt. In recent years, a conveyance speed at which the intermediate transfer belt conveys the toner image is faster in order to meet a requirement for productivity improvement. For this reason, since a time is not sufficient to separate the transfer roller from the intermediate transfer belt in the gap between the transfer materials, there is a problem that the image control toner image may be attached to the transfer material. In order to resolve this problem, the image control toner image is allowed to be attached to the intermediate transfer belt and the image control toner image is cleaned electrostatically from the intermediate transfer belt by electrically conducting a fur brush.

In some cases, the image control toner images with a wide range of density gray scales are formed in image control regions near the image formation regions of an image bearing member in order to improve tone reproducibility of a color image. In this case, when the toner of the image control toner image attached to the intermediate transfer belt is cleaned with the fur brush under a constant conductivity condition of the fur brush, there is a problem that a part of the image control toner image with some density may not be cleaned and the rear surface of the transfer material is smeared.

SUMMARY OF THE INVENTION

The present invention provides an image forming apparatus capable of improving a cleaning property of toner on an image control toner image transferred to a transfer member from an image bearing member.

An image forming apparatus includes an image bearing member that is rotatable, a toner image forming portion that is able to form a toner image to be transferred to a transfer material and a control toner image not to be transferred to a transfer material on the image bearing member, a transfer member that transfers the toner image formed on the image bearing member to the transfer material, a detecting portion that detects a density of the control toner image, an adjustment portion that adjusts a toner image formation condition of the toner image forming portion based on an output of the detecting portion, a cleaning member that electrostatically cleans the transfer member, and a controller which changes a voltage or a current to be applied between the transfer member and the cleaning member based on the density of the control toner image.

Further features of the present invention will become apparent from the following description of exemplary embodiments with reference to the attached drawings.

BRIEF DESCRIPTION OF THE DRAWINGS

FIG. 9A is a graph illustrating a correspondence relation between the density of the image control patch and the cleaning current and FIGS. 9B and 9C are tables illustrating a smeared state of the rear surface of a transfer material; FIG. 10C is a table illustrating a smeared state of the rear surface of a transfer material.

DESCRIPTION OF THE EMBODIMENTS

Hereinafter, exemplary embodiments of the invention will be described in detail with reference to the drawings. Here, since the sizes, materials, shapes, relative positions, and the like of constituent elements described in the embodiments are appropriately modified depending on the configuration of the apparatus according to the invention and various conditions, the scope of the invention is not limited to them, as long as specific description is not otherwise made.

First Embodiment

Figure 1A:
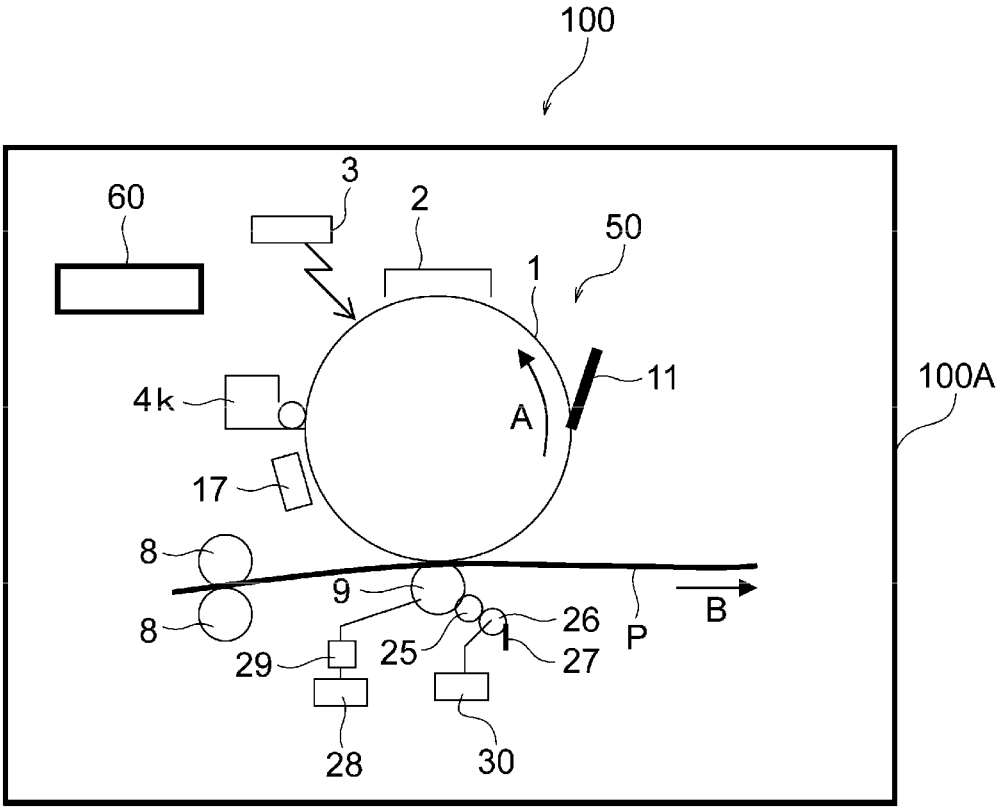
FIG. 1A is a sectional view illustrating the configuration of an image forming apparatus according to a first embodiment of the invention and FIG. 1B is a block diagram illustrating internal devices of an apparatus body.

FIG. 1A is a sectional view illustrating the configuration of an image forming apparatus 100 according to a first embodiment of the invention. The image forming apparatus 100 is an image forming apparatus that uses an electrophotographic image forming process. As illustrated in FIG. 1A, the image forming apparatus 100 has an image forming apparatus body (hereinafter, simply referred to as an "apparatus body") 100A. An image forming portion 50 which forms an image is installed inside the apparatus body 100A. The image forming portion 50 includes a photosensitive drum 1 and a transfer roller 9.

The photosensitive drum 1 which is an "image bearing member" is rotated in a direction indicated by an arrow A. A charging device 2, an exposure device 3, a development device 4*k*, a patch sensor 17, a transfer roller 9, and a cleaning device 11 are disposed around the photosensitive drum 1. The charging device 2 which is a "charging portion" is a device that uniformly charges the surface of the photosensitive drum 1. The exposure device 3 which is an "exposure portion" is a device that exposes the surface of the photosensitive drum 1 charged by the charging device 2 based on image information and forms an electrostatic image on the surface of the photosensitive drum 1. The development device 4*k* which is a "developing portion" has, for example, black (k) toner, develops the electrostatic image formed on the surface of the photosensitive drum 1 by the exposure device 3 with the toner, and forms a toner image on the surface of the photosensitive drum 1. Here, there is used a reverse development method of performing development by attaching the toner to the exposure portion of the electrostatic image.

The patch sensor 17 which is a "detecting portion" is disposed so as to face the surface of the photosensitive drum 1. The patch sensor 17 is a sensor that detects the density of an image control patch, which is a "control toner image" used for image control, when the image control patch is formed in an image control region near an image formation region of the surface of the photosensitive drum 1. The image control patch is formed in a second image formation region N2 on the surface of the photosensitive drum 1 (see FIG. 3A), which is used to form an image control image, ensured on the end portion side of the photosensitive drum 1 in its axial direction than a first image formation region N1 (see FIG. 3A), which is used to form a normal image. Accordingly, the second image formation region corresponds to an "image control region" (test pattern formation region).

The first image formation region N1 is a region extended in a sub-scanning direction K from a region where a normal output image is formed on the surface of the photosensitive drum 1. The first image formation region N1 is a region that corresponds to a region of "the size of a normal output image region in a main scanning direction J"×"the circumferential size of the photosensitive drum 1." The first image formation region N1 includes an "output image region" written in FIG. 3A. The second image formation region N2 is a region extended in the sub-scanning direction K from a region where an image control output image is formed on the surface of the photosensitive drum 1. The second image formation region N2 is a region that corresponds to a region of "the size of the image control output image region in the main scanning direction J"×"the circumferential size of the photosensitive drum 1." The second image formation region N2 corresponds to a region where the image control patch is formed in FIG. 3A.

Figure 10A:
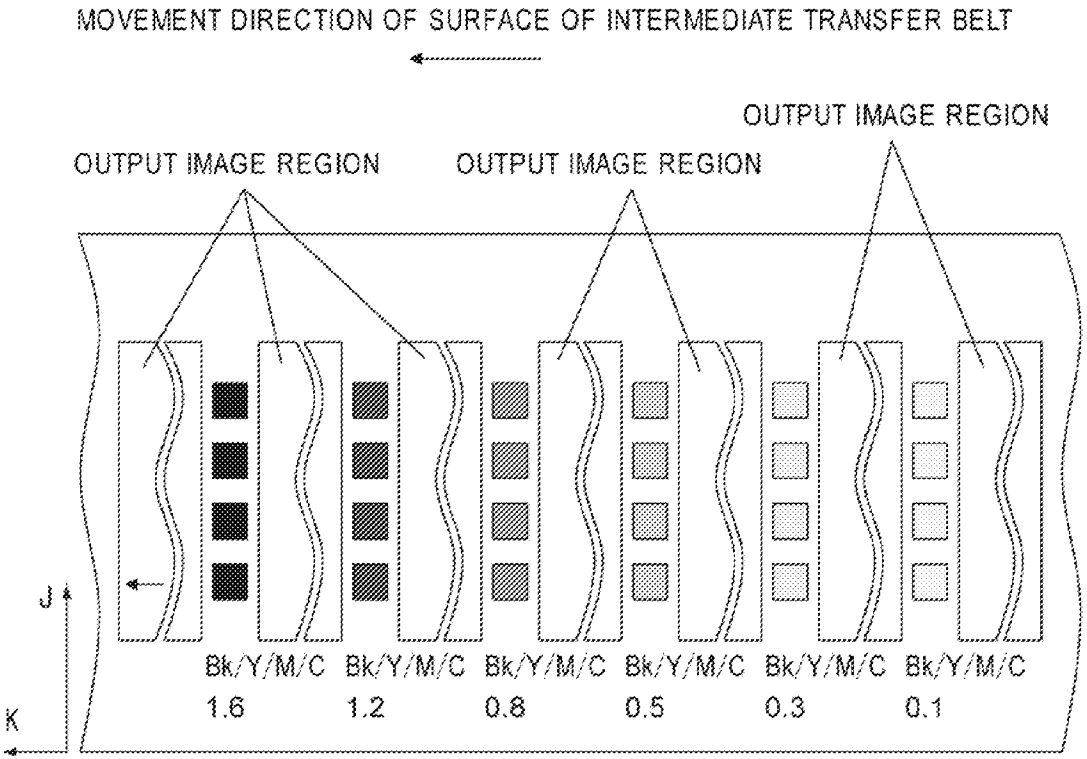
FIG. 10A is a graph illustrating a correspondence relation between the density of an image control patch and a cleaning current when an image forming apparatus is used according to a fifth embodiment of the invention.
Figure 10B:
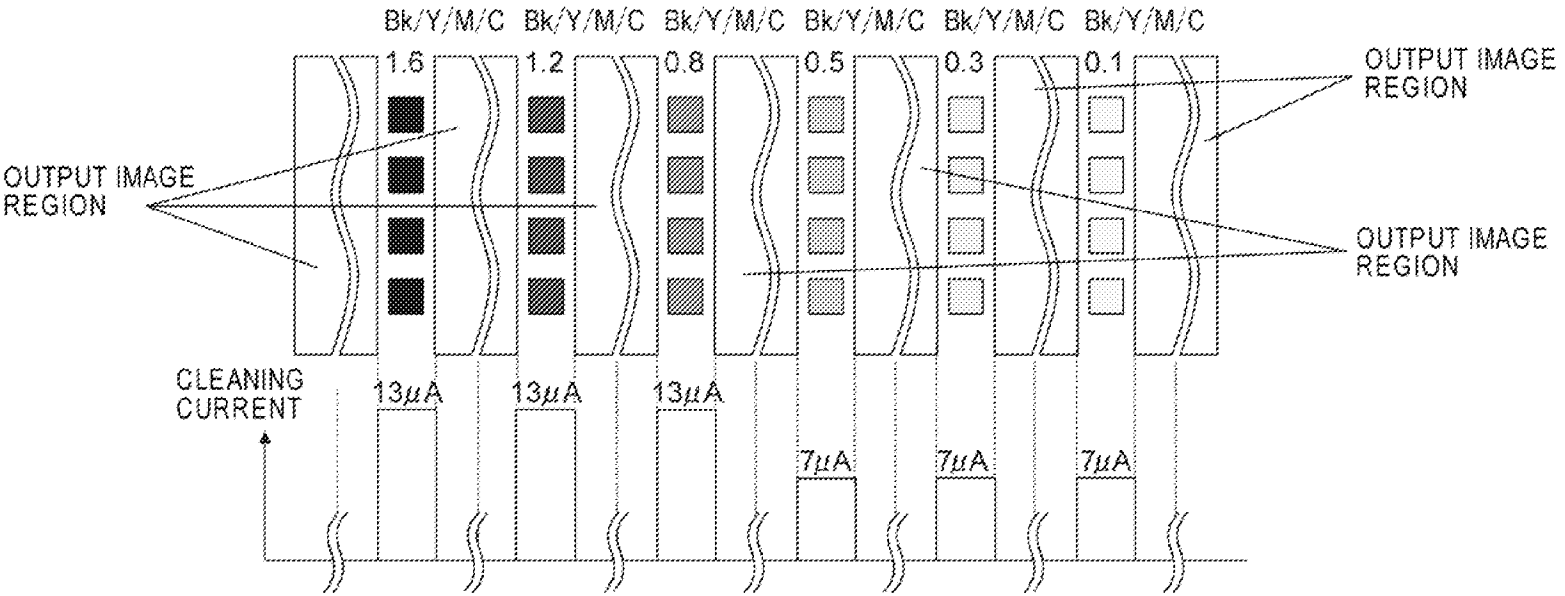
FIG. 10B is a graph illustrating a correspondence relation between the density of an image control patch and a cleaning current.

The image control region near the image formation region also includes a region between the output image region and the output image region, for example, like the surface of an intermediate transfer belt 6 illustrated in FIGS. 10A and 10B. The same is applied to the case of the photosensitive drum 1 according to the first embodiment, not the case of the intermediate transfer belt 6 according to a fifth embodiment.

The patch sensor 17 is disposed so as to face the photosensitive drum 1 and is disposed between the development device 4*k* and the transfer roller 9. The patch sensor 17 detects the density of the image control patch developed on the surface of the photosensitive drum 1.

The transfer roller 9, which is a "primary transfer roller" serving as a "transfer member", is a roller that transfers the toner image formed on the surface of the photosensitive drum 1 by the development device 4*k* to a transfer material P. The transfer roller 9 is disposed so as to face the photosensitive drum 1. A transfer high-pressure detection sensor 29 is connected to the transfer roller 9. A transfer bias applying device 28 is connected to the transfer high-pressure detection sensor 29. The transfer bias applying device 28 applies a bias with a polarity different from that of the toner to the transfer roller 9, when the transfer roller 9 transfers an unfixed toner image on the surface of the photosensitive drum 1 to the transfer material P being conveyed with a pair of registration rollers 8. For example, the transfer bias applying device 28 applies a voltage from +2000 V to +3000 V to the transfer roller 9 so that a current from +20 μA to +30 μA from the photosensitive drum 1 to the transfer roller 9. The cleaning device 11 cleans transfer residual toner on the surface of the photosensitive drum 1 at every rotation of the photosensitive drum 1 after primary transferring, so that an image is repeatedly formed. For example, when the resistance of the transfer roller 9 increases over time, the current flowing from the transfer roller 9 to the photosensitive drum 1 may decrease. Therefore, there is a concern that the negative toner is not moved from the photosensitive drum 1 to the transfer roller 9. In order to prevent this problem, that is, to maintain a constant current between the transfer roller 9 and the photosensitive drum 1, the transfer high-pressure detection sensor 29 keeps detecting the voltage or the current between the transfer roller 9 and the photosensitive drum 1.

On the other hand, the transfer material P is temporarily stopped and positioned by the pair of registration rollers 8, and then is conveyed to a primary transfer position (nip position between the photosensitive drum 1 and the transfer roller 9) at a predetermined timing. Then, the transfer material P is conveyed to a fixing device (not illustrated) and the toner is melted and fixed on the transfer material P.

A cleaning device 171 (see FIG. 2A) has a cleaning container 71. A fur brush 25, a bias roller 26, a cleaning blade 27, and the like are installed inside the cleaning container 71. The fur brush 25 is disposed at the position facing the transfer roller 9. The fur brush 25 which is a part of the cleaning apparatus 171 (see FIG. 2A) which is a "cleaning member" is a brush that electrostatically cleans the transfer roller 9. The fur brush 25 electrostatically cleans the image control patch (toner image for toner density detection) attached to the transfer roller 9 by a bias which has an opposite-polarity of that of the toner and is applied through the bias roller 26. The toner transferred to the fur brush 25 is subsequently transferred to the bias roller 26 and is scraped, detached, and collected by the cleaning blade 27. The bias roller 26 is connected to a bias applying device 30. A bias is applied from the bias applying device 30 to the bias roller 26.

The transfer roller 9 has a metal cored bar with an outer circumference of 8 mm to 12 mm. A conductive material layer is formed on the outer circumferential surface and the outer diameter thereof is configured to be 16 mm to 30 mm. The conductive material layer is a layer in which conductivity is adjusted so as to be suitable for a middle resistance region of 1 [MΩ] to 100 [MΩ] by mixing an ionic conductive material with a base material of rubber, for example, polymeric elastomer such as hydrin rubber or EPDM or a polymer foam material. A resin coat coated with, for example, urethane or nylon of 2 μm to 10 μm is used on the surface of the transfer roller 9. The transfer roller with the hardness of 25 to 40 measured by Asker C is used. Asker C is one of the durometers (spring-type hardness meter) defined in SRIS0101 (standard of the Society of Rubber Industry, Japan) and is a measurer which measures hardness.

A fur brush, which has a fur length of 4 mm, a cored bar of 10 mm, an outer circumference of 18 mm, and a resistance value from $1\times10^{+5}\Omega$ to $1\times10^{+10}\Omega$ measured by applying 100 V at N/N (23° C., 50% RH), is used as the fur brush 25. A metal roller which has an outer diameter of 13 mm to 20 mm and is made of SUS is used in the bias roller 26. A polyurethane rubber with elasticity is used in the cleaning blade 27. The fur brush 25 is disposed so as to intrude the transfer roller 9 and the bias roller 26 by 1 mm to 2 mm. The fur brush 25 is counter-rotated with respect to the transfer roller 9 (the facing surfaces thereof are rotated oppositely one another) and is forward-rotated with respect to the bias roller 26 (the facing surfaces thereof are rotated in the same direction one another) (see FIG. 2A). That is, in the case of the counter rotation, the rotation direction of the fur brush is the same as the rotation direction of the transfer roller. In the case of the forward rotation, the rotation direction of the fur brush is different from the rotation direction of the transfer roller.

A controller 60 (see FIG. 1A) controls the driving of the various internal devices of the apparatus body 100A. Further, the controller 60 performs the following control when the image control patch, which is transferred from the image control region near the image formation region of the photosensitive drum 1, on the surface of the transfer roller 9 passes through the fur brush 25. That is, the controller 60 changes a sweeping voltage or a sweeping current applied between the transfer roller 9 and the fur brush 25 based on the density of the image control patch detected by the patch sensor 17 (see FIG. 4A). Hereinafter, the sweeping voltage is referred to as a cleaning voltage and the sweeping current is referred to as a cleaning current. Further, a "toner image forming mechanism" includes the charging device 2, the exposure device 3, the development device 4*k*, the transfer roller 9, and the cleaning device 11.

Figure 1B:
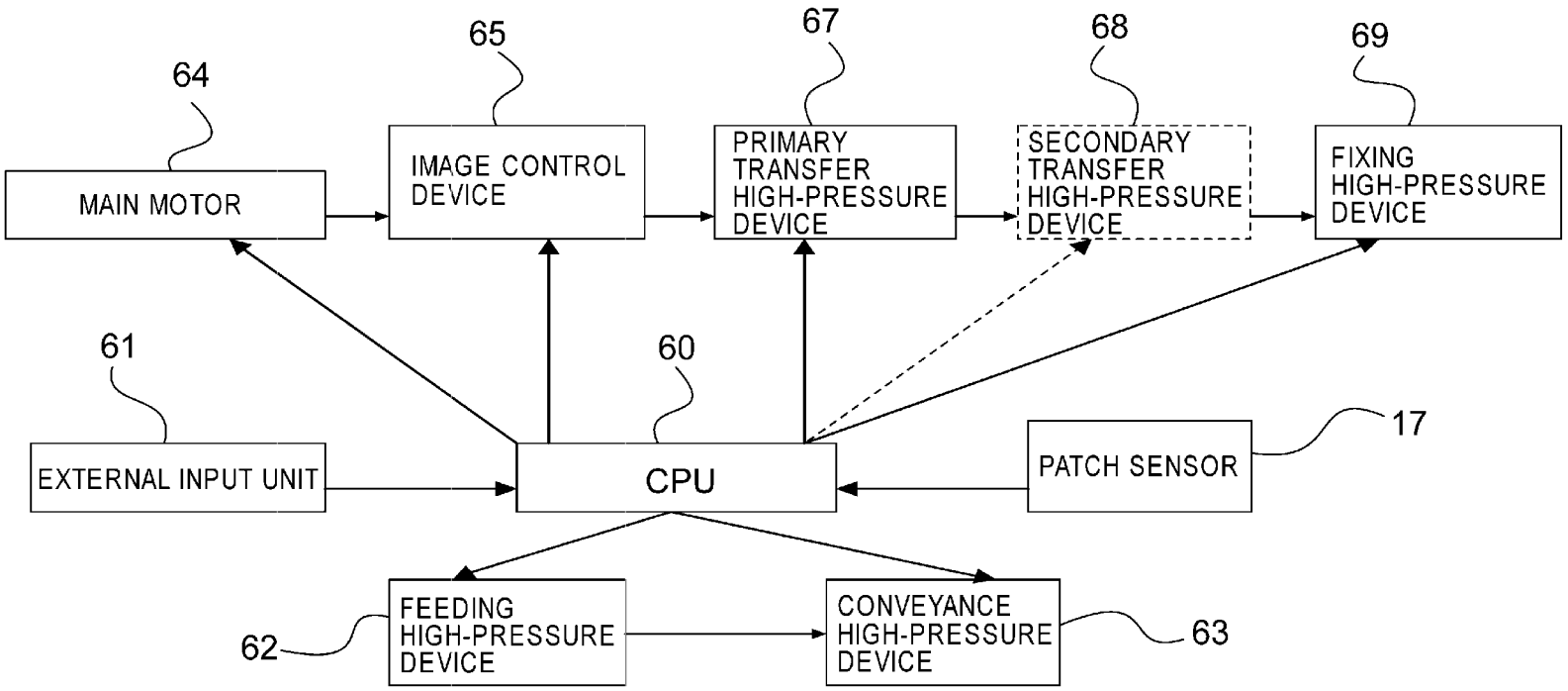

FIG. 1B is a block diagram illustrating the internal devices of the apparatus body 100A. As illustrated in FIG. 1B, the controller 60 includes a central processing unit (CPU). The controller 60 is connected to an external input unit 61, a patch sensor 17, a feeding high-pressure device 62, and a conveyance high-pressure device 63. The controller 60 is also connected to a main motor 64, an image control device 65, a primary transfer high-pressure device 67, and a fixing high-pressure device 69. In second to fifth embodiments described below, the controller 60 is also connected to a secondary transfer high-pressure device 68. However, in the first embodiment, the controller 60 is not connected to the secondary transfer high-pressure device 68.

The image control device 65 functions as a driver that drives the charging device 2, the exposure device 3, and the development device 4*k*. The primary transfer high-pressure device 67 and the fixing high-pressure device 69 function as drivers that drive the transfer roller 9 (in the second to fifth embodiments, primary transfer rollers 5Y to 5*k*), which is the primary transfer roller, and the fixing device, respectively. The secondary transfer high-pressure device 68 functions as a driver that drives the secondary transfer roller (in the second to fifth embodiments, a secondary transfer roller 19). The controller 60 controls the driving of the image control device 65 based on a driving signal received from the external input unit 61 and a detection signal received from the patch sensor 17 and drives the charging device 2, the exposure device 3, and the development device 4*k* through the image control device 65. Further, the controller 60 drives the main motor 64 to rotate the photosensitive drum 1 and drives the primary transfer high-pressure device 67, the transfer roller 9, the fixing high-pressure device 69, and the fixing device. When the secondary transfer roller 19 described in the second embodiment and the subsequent embodiments, the controller 60 drives the secondary transfer high-pressure device 68 and the secondary transfer roller 19.

Figure 2A:
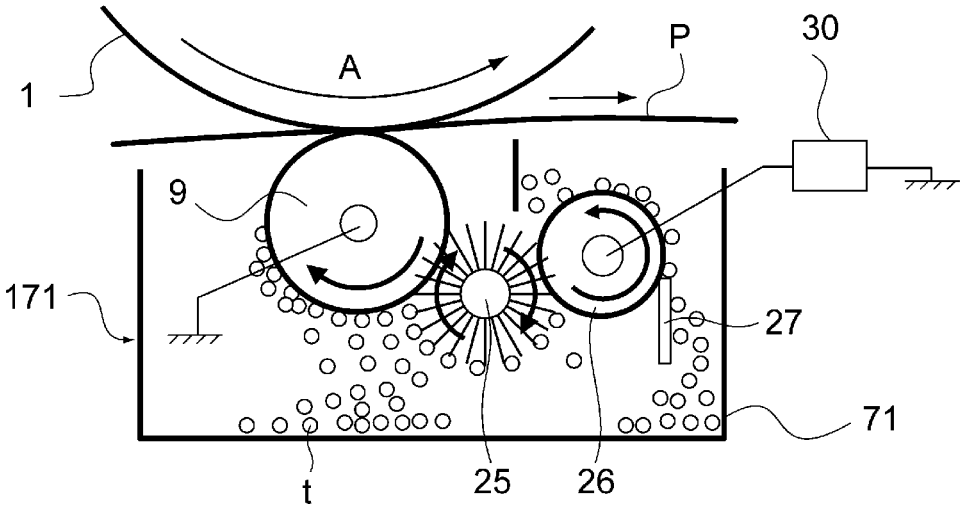
FIG. 2A is a sectional view illustrating the configuration of a fur brush, a bias roller, and a cleaning blade.

FIG. 2A is a sectional view illustrating the configuration of the fur brush 25, the bias roller 26, and the cleaning blade 27. As illustrated in FIG. 2A, the transfer roller 9, the fur brush 25, the bias roller 26, and the cleaning blade 27 are disposed inside the cleaning container 71. The fur brush 25 is disposed at the facing position of the transfer roller 9. The bias roller 26 is disposed at the facing position of the fur brush 25. The front end portion of the cleaning blade 27 is disposed at the facing position of the bias roller 26. The bias roller 26 is connected to the bias applying device 30.

The fur brush 25 is disposed so as to face the transfer roller 9. The controller 60 performs control so that the fur brush 25 is counter-rotated with respect to the transfer roller 9. That is, the rotation direction of the fur brush at the facing position of the fur brush 25 is opposite to the rotation direction of the transfer roller at the facing position of the transfer roller 9. Thus, when the fur brush 25 and the transfer roller 9 are counter-rotated one another, a work for mechanically scraping the image control toner image attached to the transfer roller 9 is applied, and thus the cleaning of the transfer roller 9 can be further stabilized.

Figure 2B:
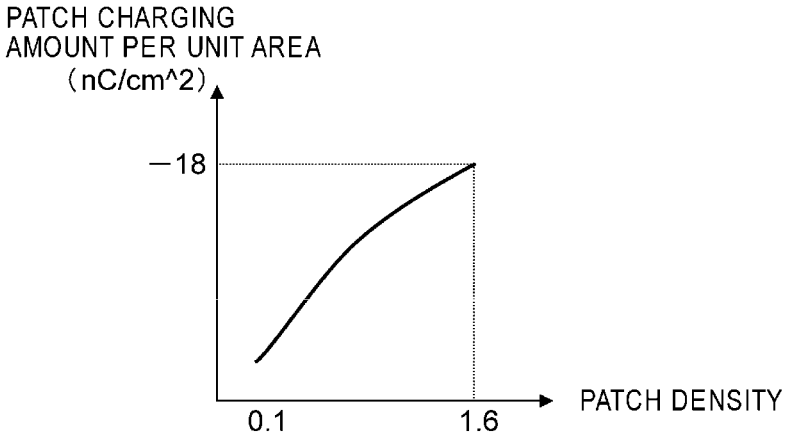
FIG. 2B is a graph illustrating a relation between a patch charging amount per unit area and the patch density.

FIG. 2B is a graph illustrating the relation between a patch charging amount per unit area and the patch density. As illustrated in FIG. 2B, the charging amount of a patch per unit area (hereinafter, referred to as a patch charging amount) is different for each the density of the patch (hereinafter, referred to as a patch density). Accordingly, an optimum cleaning current for the image control patch is different in a weak density patch and a dark density patch. When the cleaning current is low with respect to the toner charging amount of the patch per unit area, a cleaning electric field for collecting the toner becomes insufficient. Conversely, when the cleaning current is too high with respect to the toner charging amount of the patch per unit area, the polarity of the patch toner is reversed, and thus the fur brush 25 may not collect the toner. That is, for example, when the charge of the patch toner is changed from the negative to the positive, the direction of the toner is not oriented from the transfer roller 9 to the fur brush 25, but is oriented from the fur brush 25 to the transfer roller 9. Then, the toner attached to the transfer roller 9 is not cleaned.

Figure 2C:
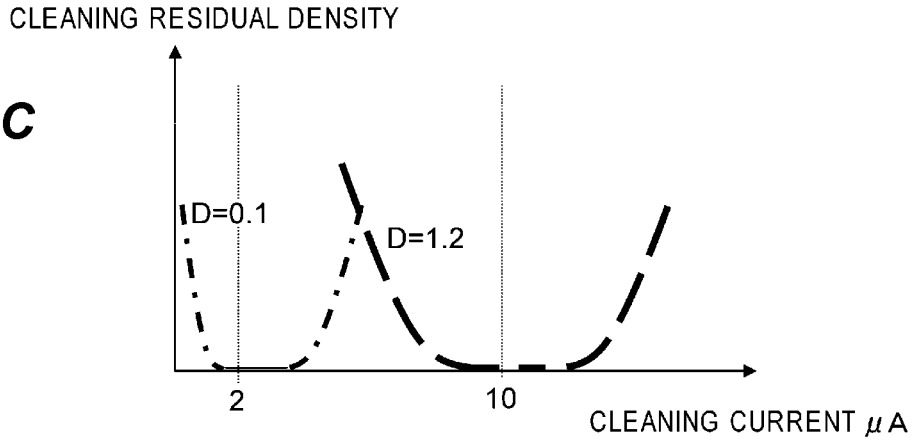
FIG. 2C is a graph illustrating a relation between a cleaning residual density and a cleaning current.

FIG. 2C is a graph illustrating a relation between the cleaning residual density and the cleaning current. When the patch density is 0.1, the optical cleaning current optimum to collect the toner is +2 μA, as illustrated in FIG. 2C. When the patch density is 1.2, the optical cleaning current optimum to collect the toner is +10 μA. When the cleaning current is set to +2 μA, the image control patch with the patch density of 0.1 is appropriately cleaned. However, the appropriate cleaning current is +10 μA in the image control patch with the patch density of 1.2. Therefore, when the cleaning current is +2 μA, the cleaning current becomes low, and thus the fur brush 25 may not sufficiently clean the toner. Further, when the cleaning current is set to +10 μA, the image control patch with the patch density of 1.2 is appropriately cleaned. However, the appropriate cleaning current is +2 μA in the image control patch with the patch density of 0.1. Therefore, when the cleaning current is +10 μA, the cleaning current is too high, and thus the polarity of the patch toner is reversed. For this reason, the toner may not be sufficiently cleaned by the fur brush 25. The controller 60 of the image forming apparatus according to this embodiment performs the constant current control so that the cleaning current has a target current value.

Figure 3A:
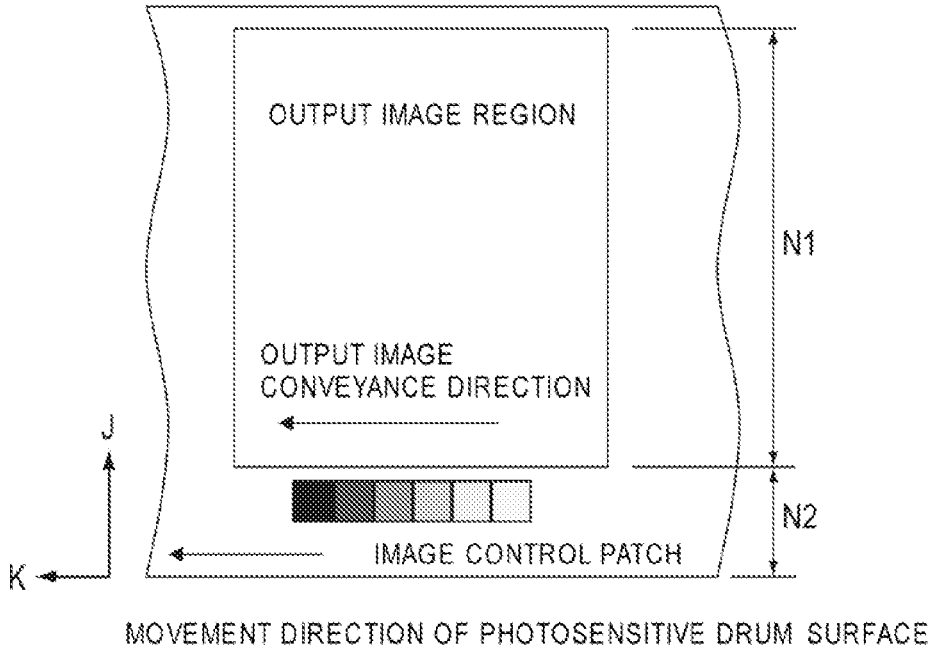
FIG. 3A is a plan view illustrating a case where an image control patch is formed on the surface of a photosensitive drum and FIG. 3B is a block diagram illustrating a control system of a controller.

FIG. 3A is a plan view illustrating a case where the image control patch is formed on the surface of a photosensitive drum 1. In the image control patch, as illustrated in FIG. 3A, the shape of one patch (pixel) has 20 mm in a sub-scanning direction K corresponding to the surface movement direction of the photosensitive drum 1 and 16 mm in the main scanning direction J. The patch densities are 1.6, 1.2, 0.8, 0.5, 0.3, and 0.1 and a total of six patches are continuously formed in the sub-scanning direction K. The patch densities are detected and the image control of the toner is performed according to the results. That is, when the patch density is deviated, a laser exposure output signal is corrected. Here, the patch density is a value measured by a density measurer (manufactured by X-Rite, Incorporated.) when the patch is transferred to the transfer material P. The density of the patch has no unit.

Figure 3B:
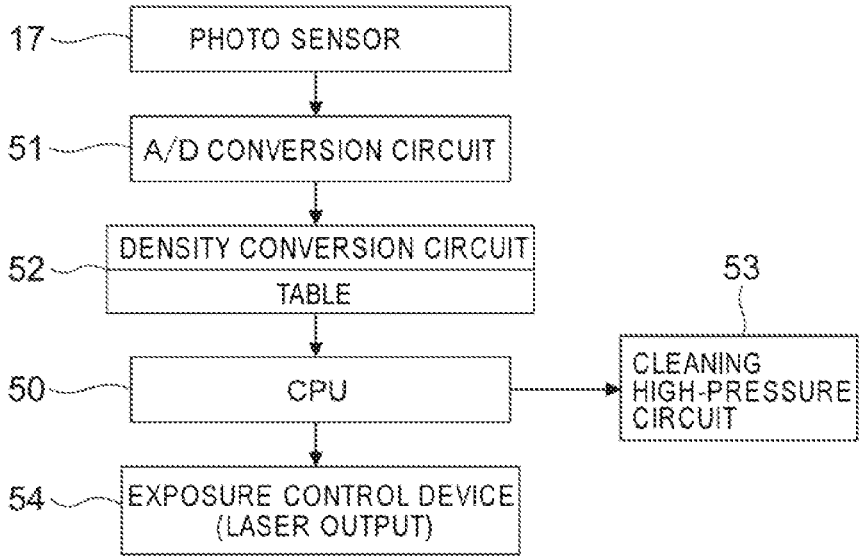

FIG. 3B is a block diagram illustrating a control system of the controller 60. For example, a photo sensor is used in the patch sensor 17. The detection signal detected by the patch sensor 17 is converted from an analog signal into a digital signal by an A/D conversion circuit 51. The degree of the patch density is converted into a predetermined numerical value by a density conversion circuit 52 and the predetermined numeral value is transmitted to the controller 60. The controller 60 transmits the received predetermined numerical information to the cleaning high-pressure circuit 53. The cleaning high-pressure circuit 53 applies a predetermined voltage into the bias roller 26. In this way, the cleaning current based on the density information flows in the bias roller 26. The controller 60 allows an exposure control device 54 to control the driving of the exposure device 3 and output a laser.

Figures 4A, 4B:
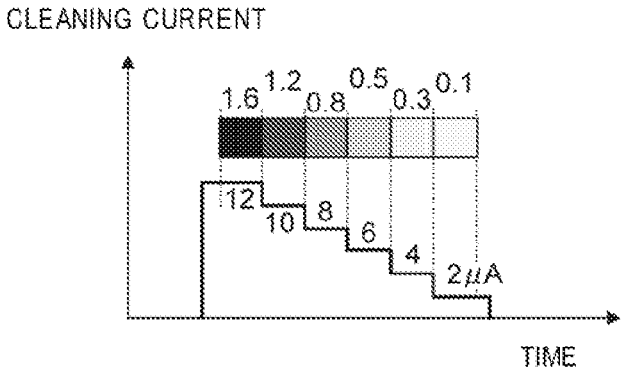
FIG. 4A is a graph illustrating a relation between a cleaning current and a time at which patches pass through a patch sensor and FIG. 4B is a table illustrating a state where the rear surface of a transfer material is smeared.

FIG. 4A is a graph illustrating a relation between the cleaning current and a time at which the patches pass through the patch sensor 17. A rectangle on the upper side of the graph indicates the patch densities of the image control patches. A step shape on the lower side of the graph indicates the magnitude of the cleaning current. When an experiment of the graph is carried out, the controller 60 allows the patch sensor 17 to detect the patch densities of the image control patches formed on the surface of the photosensitive drum 1. Then, the controller 60 flows the cleaning current by applying the voltage by the constant current control in synchronization with the passing of the patches attached on the transfer roller through the fur brush 25 and changes the cleaning current according to the patch densities. In this case, the controller 60 sets the absolute value of the cleaning voltage or the absolute value of the cleaning current applied between the transfer roller 9 and the fur brush 25 so as to be higher, as the density of the image control patch is higher. Further, the controller 60 sets the absolute value of the cleaning voltage or the absolute value of the cleaning current applied between the transfer roller 9 and the fur brush 25 so as to be lower, as the density of the image control patch is lower.

Specifically, the controller 60 sets the voltage applied to the fur brush 25 so as to be higher than the voltage applied to the transfer roller 9, when negative toner is used. Further, the controller 60 sets the voltage applied to the fur brush 25 so as to be higher and sets the cleaning current flowing from the fur brush 25 to the transfer roller 9 so as to be higher, as the density of the image control patch is higher. Furthermore, the controller 60 sets the voltage applied to the fur brush 25 so as to be lower and sets the cleaning current flowing from the fur brush 25 to the transfer roller 9 so as to be lower, as the density of the image control patch is lower. The direction of the negative toner is opposite to the direction of the current.

On the contrary, the controller 60 sets the voltage applied to the transfer roller 9 so as to be higher than the voltage applied to the fur brush 25, when positive toner is used. Further, the controller 60 sets the voltage applied to the fur brush 25 so as to be lower and sets the cleaning current flowing from the fur brush 25 to the transfer roller 9 so as to be higher, as the density of the image control patch is higher. Furthermore, the controller 60 sets the voltage applied to the fur brush 25 so as to be higher and sets the cleaning current flowing from the fur brush 25 to the transfer roller 9 so as to be lower, as the density of the image control patch is lower.

The controller 60 sets the cleaning voltage or the cleaning current for each density of a predetermined range, when the image control patch has a plurality of densities. In the graph, the patch densities are set to 1.6 (1.4 or more and less than 1.8), 1.2 (1.0 or more and less than 1.4), 0.8 (0.6 or more and less than 1.0), 0.5 (0.4 or more and less than 0.6), 0.3 (0.2 or more and less than 0.4), and 0.1 (0 or more and less than 0.2). In this order, the controller 60 controls the cleaning current with constant currents of +12 μA, +10 μA, +8 μA, +6 μA, +4 μA, and +2 μA. Thus, the toner can be collected by the fur brush 25 without excess or deficiency (cleaning failure caused by the deficiency of the cleaning electric field or polarity reversing of the toner caused due to the excess of the cleaning current amount) of the cleaning electric field with respect to the toner charging amount of the patch per unit area. Other high voltage for cleaning flows with a current of about 0.1 μA to about 1.0 μA without ejection of the toner from the fur brush 25.

FIG. 4B is a table illustrating a state where the rear surface of the transfer material P is smeared. In FIG. 4B, "good" indicates a case where it is determined that there is no rear sheet smear and "no good" indicates a case where it is determined that there is rear sheet smear. As illustrated in FIG. 4B, the patches of all the densities can be collected from the transfer roller 9 and the transfer roller 9 can be cleaned when the cleaning current is controlled according to the method of the first embodiment. On the other hand, when the method of controlling the cleaning currents fixed to +10 μA, +6 μA, and +2 μA is used, all the density patches are not cleaned from the transfer roller 9. As a consequence, the toner of some patch densities is not collected, and thus the rear surface of the transfer material P is smeared.

That is, in the first embodiment, the controller 60 changes the cleaning current by the output applied to the bias roller 26 by the bias applying device 30 according to the density of the image control patch detected by the patch sensor 17. Thus, the toner of all the patch densities is collected.

On the other hand, the controller 60 sets the cleaning current to +10 μA by the output applied to the bias roller 26 by the bias applying device 30. When the patch densities are 0.1, 0.3, and 0.5, the appropriate cleaning currents are +2 μA, +4 μA, and +6 μA, respectively. When the cleaning current is +10 μA, the cleaning electric field becomes excessive. Accordingly, in the case of this patch density, the toner is not collected and the rear surface of the transfer material P is smeared.

The controller 60 sets the cleaning current to +6 μA by the output applied to the bias roller 26 by the bias applying device 30. When the patch density is 0.1, the appropriate cleaning current is +2 μA. When the cleaning current is +6 μA, the cleaning electric field becomes excessive. Further, when the patch densities are 1.2 and 1.6, the appropriate cleaning currents are +10 μA and +12 μA, respectively. When the cleaning current is +6 μA, the cleaning electric field becomes deficient. Accordingly, in the case of this patch density, the toner is not collected and the rear surface of the transfer material P is smeared.

The controller 60 sets the cleaning current to +2 μA by the output applied to the bias roller 26 by the bias applying device 30. When the patch densities are 0.5, 0.8, 1.2, and 1.6, the appropriate cleaning currents are +6 μA, +8 μA, +10 μA, and +12 μA, respectively. When the cleaning current is +2 μA, the cleaning electric field becomes deficient. Accordingly, in the case of this patch density, the toner is not collected and the rear surface of the transfer material P is smeared.

In this embodiment and the subsequent embodiments, the cleaning current is changed according to the density of the image control patch detected by the patch sensor 17 by the output applied to the bias roller 26 by the bias applying device 30. However, the patch sensor 17 may not detect the density of the image control patch. Based on an image signal indicating the image control patch, the cleaning current may be changed by the output applied to the bias roller 26 by the bias applying device 30. Further, an "adjustment portion" is a unit that adjusts the toner image formation condition of the "toner image forming portion" through the image control device 65 of the controller 60. Furthermore, the "controller" is a unit which changes the voltage or the current applied between the transfer member (the transfer roller 9 or the secondary transfer roller 19) and the buffer roller 26 through the primary transfer high-pressure device 67 of the controller 60.

Second Embodiment

Figure 5A:
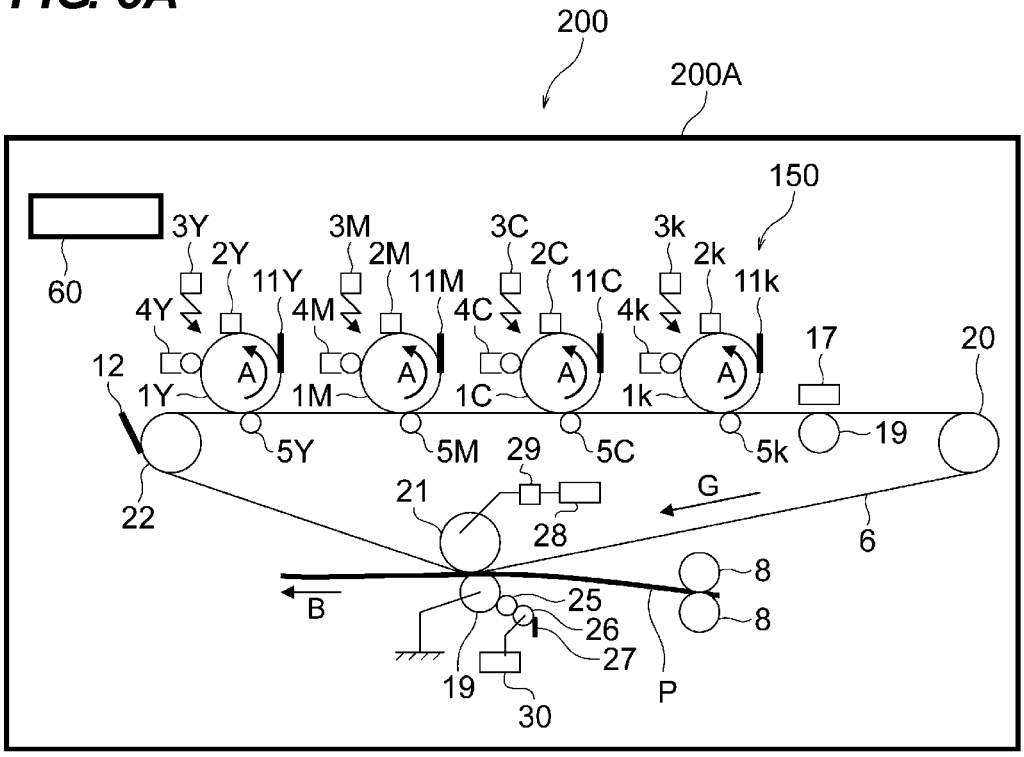
FIG. 5A is a sectional view illustrating the configuration of an image forming apparatus according to a second embodiment of the invention and FIG. 5B is a sectional view illustrating the configuration of a fur brush, a bias roller, and a cleaning blade.

FIG. 5A is a sectional view illustrating the configuration of an image forming apparatus 200 according to the second embodiment of the invention. The image forming apparatus 200 is an image forming apparatus that uses an electrophotographic image forming process. As illustrated in FIG. 5A, the image forming apparatus 200 has an image forming apparatus body (hereinafter, simply referred to as an "apparatus body") 200A. An image forming portion 150 which forms an image is installed inside the apparatus body 200A. The image forming portion 150 includes photosensitive drums 1Y, 1M, 1C, and 1*k* and primary transfer rollers 5Y, 5M, 5C, and 5*k*. Hereinafter, description will be made in detail.

The photosensitive drums 1Y, 1M, 1C, and 1*k* which are "first image bearing members" are disposed inside the apparatus body 200A. The photosensitive drums 1Y, 1M, 1C, and 1*k* are rotated in the direction indicated by an arrow A. Charging devices 2Y, 2M, 2C, and 2*k*, exposure devices 3Y, 3M, 3C, and 3*k*, and development devices 4Y, 4M, 4C, and 4*k* are disposed so as to face the surface of the photosensitive drums 1Y, 1M, 1C, and 1*k*, respectively. Primary transfer rollers 5Y, 5M, 5C, and 5*k* and cleaning devices 11Y, 11M, 11C, and 11*k*, are disposed so as to face the surface of the photosensitive drums 1Y, 1M, 1C, and 1*k*, respectively. The charging devices 2Y, 2M, 2C, and 2*k* which are "charging portions" are devices that uniformly charge the surfaces of the photosensitive drums 1Y, 1M, 1C, and 1*k*. The exposure devices 3Y, 3M, 3C, and 3*k* which are "exposure portions" are devices that expose the surfaces of the photosensitive drums 1Y, 1M, 1C, and 1*k* charged by the charging devices 2Y, 2M, 2C, and 2*k* based on image information and form electrostatic images on the surfaces of the photosensitive drums 1Y, 1M, 1C, and 1*k*, respectively.

The development devices 4Y, 4M, 4C, and 4*k* which are "developing portions" are devices that develop the electrostatic images formed on the surfaces of the photosensitive drums 1Y, 1M, 1C, and 1*k* by the exposure devices 3Y, 3M, 3C, and 3*k* with toner and form toner images, respectively. The development devices 4Y, 4M, 4C, and 4*k* have chromatic color toners of yellow (Y), magenta (M), cyan (C), and black (k), respectively. The above-described electrostatic images are developed by the development devices 4Y, 4M, 4C, and 4*k* and the toner images are formed on the surfaces of the photosensitive drums 1Y, 1M, 1C, and 1*k*, respectively. Here, there is used a reverse development method of performing development by attaching the toner to the exposure portions of the electrostatic images.

An intermediate transfer belt 6 is disposed so as to face the photosensitive drums 1Y, 1M, 1C, and 1*k* at the position of the downstream side of the rotation direction of the photosensitive drums 1Y, 1M, 1C, and 1*k*, when viewed from the development devices 4Y, 4M, 4C, and 4*k*. The intermediate transfer belt 6 which is a "second image bearing member" serving as the "image bearing member" is a belt that is disposed so as to face the photosensitive drums 1. The intermediate transfer belt 6 is disposed so as to be abutted on the surfaces of the photosensitive drums 1. The intermediate transfer belt 6 is stretched by a plurality of stretching rollers 20 and 22 and a counter roller 21 and is rotatably moved in a direction indicated by an arrow G. The stretching roller 20 is a tension roller that uniformly controls the tensile force of the intermediate transfer belt 6, the stretching roller 22 is a driving roller of the intermediate transfer belt 6, and the counter roller 21 is a secondary transfer counter roller. Here, as the intermediate transfer belt 6, a belt is used which contains carbon black serving as an antistatic agent mixed in resin such as polyimide or polycarbonate or various rubbers and has a volume resistivity of $1\times10^{8}$ [Ω·cm] to $1\times10^{13}$ [Ω·cm] and a thickness of 0.07 [mm] to 0.1 [mm].

The primary transfer rollers 5Y, 5M, 5C, and 5*k* which are "first transfer rollers" are rollers that transfer the toner images formed on the surfaces of the photosensitive drums 1Y, 1M, 1C, and 1*k* to the intermediate transfer belt 6, respectively.

The intermediate transfer belt 6 with an endless belt shape is disposed so as to face the photosensitive drums 1Y, 1M, 1C, and 1*k*. The first primary transfer roller 5Y primarily transfers the unfixed toner image on the photosensitive drum 1Y electrostatically to the intermediate transfer belt 6. Subsequently, the unfixed toner images on the photosensitive drums 1M, 1C, and 1*k*, are primarily transferred so as to be superimposed and the unfixed toner images of four colors are superimposed on the intermediate transfer belt 6 to obtain a full-color image.

The primary transfer rollers 5Y, 5M, 5C, and 5*k* are disposed on the rear surface side of the intermediate transfer belt 6 at the primary transfer positions at which the intermediate transfer belt 6 faces the photosensitive drums 1Y, 1M, 1C, and 1*k*. The toner images on the photosensitive drums 1Y, 1M, 1C, and 1*k* are configured to be primarily transferred on the intermediate transfer belt 6 by applying a first transfer bias with a positive polarity which is opposite to the charging polarity of the toner to the primary transfer rollers 5Y, 5M, 5C, and 5*k*.

The cleaning devices 11Y, 11M, 11C, and 11*k* (drum cleaning devices) eliminate the toner remaining on the surfaces of the photosensitive drums 1Y, 1M, 1C, and 1*k* subjected to the primary transferring at every rotation of the photosensitive drums 1Y, 1M, 1C, and 1*k*. Then, the images are repeatedly formed on the surfaces of the photosensitive drums 1Y, 1M, 1C, and 1*k*.

A secondary transfer roller 19 and a counter roller 21 are provided at a secondary transfer position at which the intermediate transfer belt 6 comes into contact with a conveyance path of the transfer material P. The secondary transfer roller 19 which is a "secondary transfer roller" serving as the "transfer member" is a roller that transfers the toner images formed on the surface of the intermediate transfer belt 6 to the transfer material P. The secondary transfer roller 19 is disposed so as to be pressed toward the side of the toner image bearing surface of the intermediate transfer belt 6. The secondary transfer roller 19 is grounded. The counter roller 21 is disposed on the side of the rear surface of the intermediate transfer belt 6 and forms an opposite electrode of the secondary transfer roller 19 so that a bias is applied. When the toner images on the intermediate transfer belt 6 are transferred to the transfer material P, the bias with the same polarity as that of the toner is applied to the counter roller 21 by the transfer bias applying device 28. For example, the bias with −2000 V to −3000 V is applied. Thus, a current of −40 μA to −50 μA flows from the counter roller 21 to the secondary transfer roller 19. Further, a cleaning device 12 (belt cleaning device) eliminating the toner remaining on the intermediate transfer belt 6 after secondary transferring is disposed on the downstream side of the secondary transfer position. A method of setting the transfer voltage is configured to perform constant current control so that a preset target current is reached or to perform constant voltage control so that a preset target voltage is reached. In this embodiment, the condition of the transfer voltage when the image control patch image passes through the secondary transfer position is the same even when the density of the image control patch is changed.

The transfer material P is temporarily positioned and stopped by the pair of registration rollers 8, and then is sent to the secondary transfer position at a predetermined timing. Further, the transfer material P subjected to the secondary transferring is conveyed to a fixing device (not illustrated) by a conveyance member (not illustrated) so that the toner is melted and fixed to the transfer material P.

The fur brush 25 which is a "cleaning member" is a brush that electrostatically cleans the secondary transfer roller 19. The fur brush 25 electrostatically cleans the toner density detection toner image attached to the secondary transfer roller 19 by the use of the bias, which is applied through the bias roller 26, with the opposite polarity to that of the toner. The toner transferred to the fur brush 25 is subsequently transferred to the bias roller 26 and is scraped, detached, and collected by the cleaning blade 27.

The patch sensor 17 which is a "detecting portion" is disposed so as to face the surface of the intermediate transfer belt 6. The patch sensor 17 is a sensor that detects the density of the image control patch when the image control patch which is an "image control toner image" used for image control is formed on the surface of the intermediate transfer belt 6. The image control patch is formed in a fourth image formation region N4 (see FIG. 6A), which is used to form an image control image, ensured on the end portion side of the photosensitive drum 1 in its axial direction than a third image formation region N3 (see FIG. 6A), which is used to form a normal image.

The controller 60 which is a "controlling portion" performs the following control based on the density of the image control patch detected by the patch sensor 17, when the image control patch passes through the fur brush 25. That is, the controller 60 changes the cleaning voltage or the cleaning current applied between the secondary transfer roller 19 and the bias roller 26. Further, a "toner image forming mechanism" includes the charging devices 2Y to 2*k*, the exposure devices 3Y to 3*k*, the development devices 4Y to 4*k*, the primary transfer rollers 5Y to 5*k*, the cleaning device 12, and the secondary transfer roller 19.

Figure 5B:
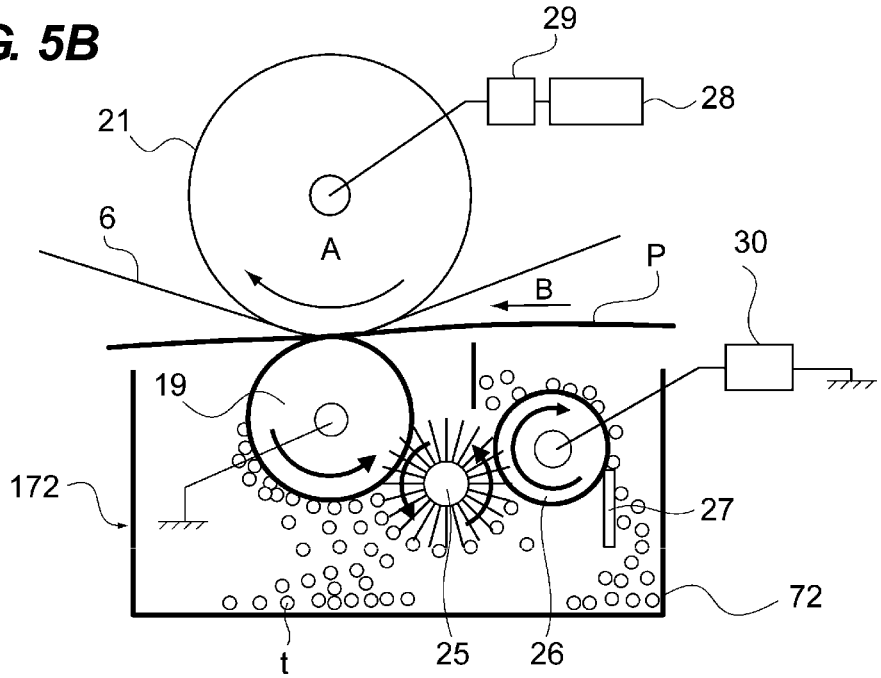

FIG. 5B is a sectional view illustrating the configuration of the fur brush 25, the bias roller 26, and the cleaning blade 27. As illustrated in FIG. 5B, the secondary transfer roller 19, the fur brush 25, the bias roller 26, and the cleaning blade 27 are disposed inside a cleaning container 72 of a cleaning device 172. The fur brush 25 is disposed at the facing position of the secondary transfer roller 19. The bias roller 26 is disposed at the facing position of the fur brush 25. The front end portion of the cleaning blade 27 is disposed at the facing position of the bias roller 26.

More specifically, the fur brush 25 is disposed so as to face the secondary transfer roller 19 and is configured to be counter-rotated with respect to the secondary transfer roller 19. That is, the rotation direction at the counter facing position of the fur brush 25 is configured to be opposite to the rotation direction of the facing position of the secondary transfer roller 19. Thus, when the fur brush is counter-rotated with respect to the secondary transfer roller 19, a work for mechanically scraping the image control toner images attached to the secondary transfer roller 19 is applied, and thus the cleaning of the secondary transfer roller 19 can be further stabilized. Further, the fur brush 25 and the bias roller 26 are forward rotated (the facing surfaces thereof are rotated in the same direction).

Figure 6A:
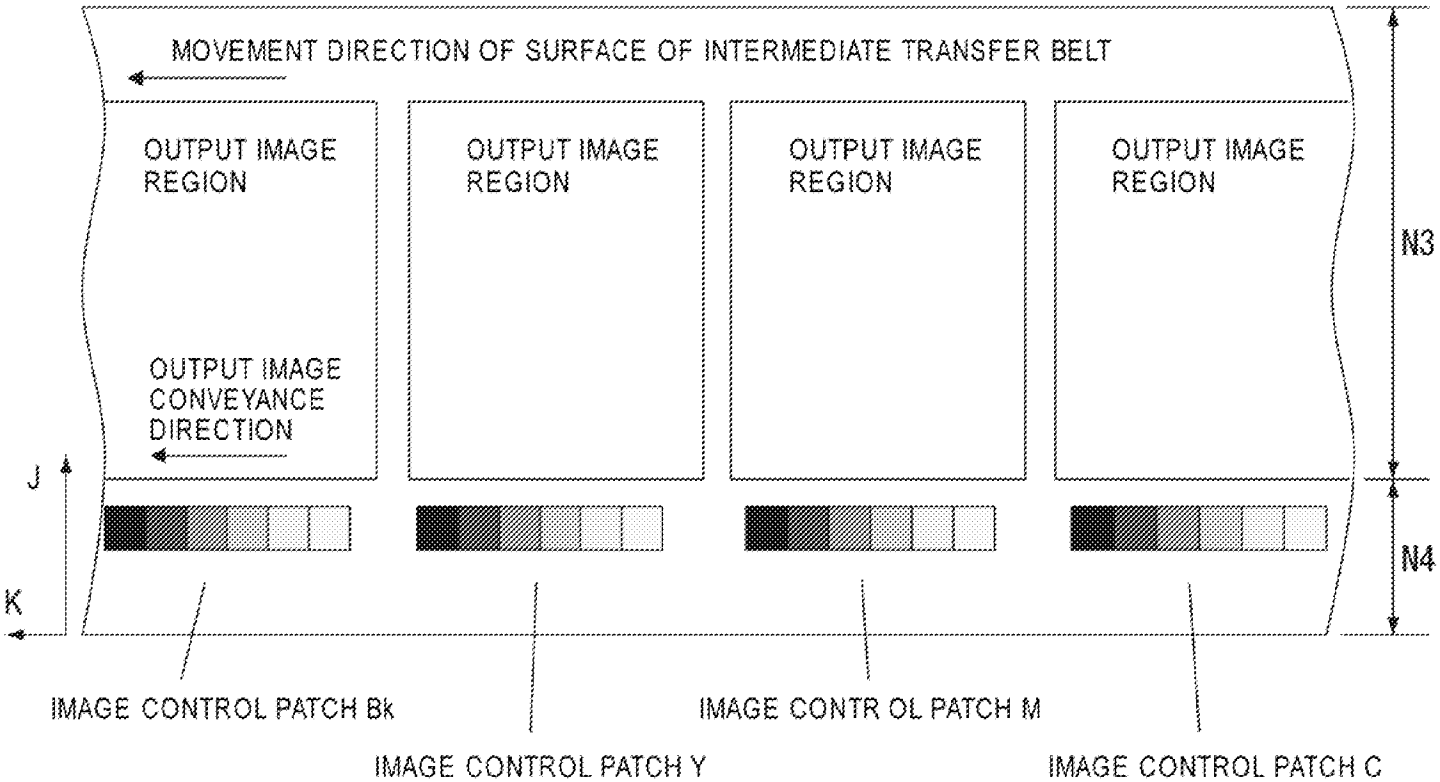
FIG. 6A is a plan view illustrating a case where image control patches are formed on the surface of an intermediate transfer belt.

FIG. 6A is a plan view illustrating a case where the image control patch is formed on the surface of the intermediate transfer belt 6. In the image control patch, as illustrated in FIG. 6A, the shape of one patch has 20 mm in the sub-scanning direction K and 16 mm in the main scanning direction J. A total of six image control patches are continuously formed in the sub-scanning direction K in the order of the patch densities of 1.6, 1.2, 0.8, 0.5, 0.3, and 0.1.

Here, it is assumed that the previous image control patch and the subsequent image control patch adjacent to each other with a predetermined gap in the movement direction of the intermediate transfer belt 6 are present on the surface of the intermediate transfer belt 6. In this case, the controller 60 sets the predetermined gap between the previous image control patch and the subsequent image control patch to be larger, as the density difference between the previous image control patch and the subsequent image control patch is larger. The same is applied to the surface of the photosensitive drum 1 of the first embodiment and to the surface of the intermediate transfer belt 6 of third to fifth embodiments.

For example, the gap between the continuously formed patches is at least 3 mm. That is, the distance between a "portion of an image control patch Bk with the patch density of 0.1" and a "portion of an image control patch Y with the patch density of 1.6" is set to at least 3 mm. Likewise, the distance between the "portion of an image control patch Y with the patch density of 0.1" and a "portion of an image control patch M with the patch density of 1.6" is set to at least 3 mm. The distance between the "portion of an image control patch M with the patch density of 0.1" and a "portion of an image control patch C with the patch density of 1.6" is set to at least 3 mm. In FIG. 6A, the right end of the intermediate transfer belt 6 is cut, and thus the gap is not apparent. In FIG. 6A, when the image control patch Bk is present on the right side of the image control patch C, the gap between the portion of the image control patch C with the patch density of 0.1 and the portion of the image control patch Bk with the patch density of 1.6 is set to at least 3 mm. The patch densities are detected and the image control of the toner is performed according to the detection result. Here, the patch densities are values measured by a density measurer (manufactured by X-Rite, Incorporated.) when the patch is transferred to the transfer material P.

In the second embodiment, the controller 60 controls the image control patches so that the gap between the image control patches in the sub-scanning direction K is larger as the difference between the densities of the previous and subsequent image control patches is larger, when changing the output applied to the fur brush 25. The same is applied to the third to fifth embodiments. When the image control patch with a high density is adjacent to the image control patch with a low density at a predetermined gap in the sub-scanning direction K and the intermediate transfer belt is electrostatically cleaned, the predetermined gap between the toner images in the sub-scanning direction K is set to be large under the control of the controller 60. Thus, since the electrostatic cleaning electric field appropriate for the patch toner can be formed, that is, a control following time can be ensured for the cleaning voltage or the cleaning current applied to the bias roller 26, stable cleaning can be performed.

The primary transfer roller 5 and the secondary transfer roller 19 have a metal cored bar with an outer diameter of 8 mm to 12 mm. A conductive material layer is formed on the outer circumferential surface and the outer diameter thereof is configured to be 16 mm to 30 mm. The conductive material layer is a layer in which conductivity is adjusted so as to be suitable for a middle resistance region of 1 [MΩ] to 100 [MΩ] by mixing an ionic conductive material with a base material of rubber, for example, polymeric elastomer such as hydrin rubber or EPDM or a polymer foam material. A resin coat coated with, for example, urethane or nylon of 2 μm to 10 μm is used on the surface of the secondary transfer roller 19. The secondary transfer roller 19 with the hardness of 25 to 40 measured by Asker C is used.

The fur brush 25, which has a fur length of 4 mm, a cored bar of 10 mm in diameter, an outer circumference of 18 mm in diameter, and a resistance value from $1\times10^{5}\Omega$ to $1\times10^{10}\Omega$ measured by applying 100 V at N/N (23° C., 50% RH), is used as the fur brush 25. A metal roller which has an outer diameter of 13 mm to 20 mm and is made of SUS is used in the bias roller 26. A polyurethane rubber with elasticity is used in the cleaning blade 27. The fur brush 25 is disposed so as to intrude the secondary transfer roller 19 and the bias roller 26 by 1 mm to 2 mm. The fur brush 25 is counter-rotated with respect to the secondary transfer roller 19 and is forward-rotated with respect to the bias roller 26. The control system of the controller is the same as the control system described with reference to FIG. 3B.

Figures 6B, 6C:
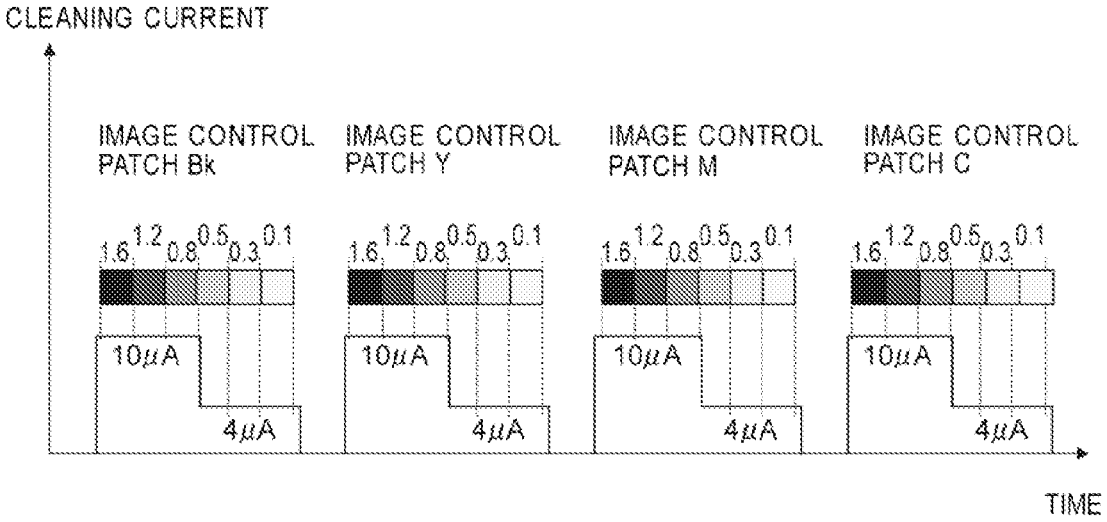
FIG. 6B is a graph illustrating a relation between a cleaning current and a time at which the patch passes through a patch sensor.
FIG. 6C is a table illustrating a state where the rear surface of a transfer material is smeared.

FIG. 6B is a graph illustrating a relationship between the cleaning current and a time at which the patches pass through the patch sensor 17. A rectangle on the upper side of the graph indicates the patch densities of the image control patches. Step shapes on the lower side of the graph indicate the magnitude of the cleaning current. When an experiment of the graph is carried out, the controller 60 allows the patch sensor 17 to detect the patch densities of the image control patches formed on the surface of the intermediate transfer belt 6. Then, the controller 60 flows the cleaning current by applying the voltage by the constant current control in synchronization with the passing of the patches attached on the secondary transfer roller 19 through the fur brush 25 and changes the cleaning current according to the patch densities.

Here, the controller 60 controls the cleaning current with the constant current of +10 μA in the portions with the patch densities of 1.6 (1.4 or more and less than 1.8), 1.2 (1.0 or more and less than 1.4), and 0.8 (0.6 or more and less than 1.0). Further, the controller 60 controls the cleaning current with the constant current of +4 μA in the portions with the patch densities of 0.5 (0.4 or more and less than 0.6), 0.3 (0.2 or more and less than 0.4), and 0.1 (0 or more and less than 0.2). Thus, the toner can be collected by the fur brush 25 without excess or deficiency (cleaning failure caused by the deficiency of the cleaning electric field or polarity reversing of the toner caused due to the excess of the cleaning current amount) of the cleaning electric field with respect to the toner charging amount of the patch per unit area. Other high voltage for cleaning flows with a current of about 0.1 μA to about 1.0 μA without ejection of the toner from the fur brush 25. In this embodiment, the patch sensor 17 detects the densities of the image control patches. However, based on an image signal indicating the image control patch, the cleaning current may be changed by the output applied to the bias roller 26 by the bias applying device 30.

FIG. 6C is a table illustrating a state where the rear surface of the transfer material P is smeared. In FIG. 6C, "good" indicates a case where it is determined that there is no rear sheet smear and "no good" indicates a case where it is determined that there is rear sheet smear. As illustrated in FIG. 6C, the patches of all the densities can be cleaned from the secondary transfer roller 19 when the method of controlling the cleaning current according to the second embodiment is used. On the other hand, when the method of controlling the fixed cleaning current is used, the patches of all densities are not cleaned from the secondary transfer roller 19. As a consequence, the rear surface of the transfer material P is smeared.

That is, in the second embodiment, the controller 60 changes the cleaning current by the output applied to the bias roller 26 by the bias applying device 30 according to the density of the image control patch detected by the patch sensor 17. Thus, the toner of all the patch densities is collected.

On the other hand, the controller 60 sets the cleaning current to +10 μA by the output applied to the bias roller 26 by the bias applying device 30. When the patch densities are 0.1, 0.3, and 0.5, the appropriate cleaning currents are +2 μA, +4 μA, and +6 μA, respectively. When the cleaning current is +10 μA, the cleaning electric field becomes excessive. Accordingly, in the case of this patch density, the toner is not collected and the rear surface of the transfer material P is smeared.

The controller 60 sets the cleaning current to +6 μA by the output applied to the bias roller 26 by the bias applying device 30. When the patch density is 0.1, the appropriate cleaning current is +2 μA. When the cleaning current is +6 μA, the cleaning electric field becomes excessive. Further, when the patch densities are 1.2 and 1.6, the appropriate cleaning currents +10 μA and +12 μA, respectively. When the cleaning current is +6 μA, the cleaning electric field becomes excessive. Accordingly, in the case of this patch density, the toner is not collected and the rear surface of the transfer material P is smeared.

The controller 60 sets the cleaning current to +4 μA by the output applied to the bias roller 26 by the bias applying device 30. When the patch densities are 0.8, 1.2, and 1.6, the appropriate cleaning currents are +8 μA, +10 μA, and +12 μA, respectively. When the cleaning current is +4 μA, the cleaning electric field becomes deficient. Accordingly, in the case of this patch density, the toner is not collected and the rear surface of the transfer material P is smeared.

Third Embodiment

Figure 7A:
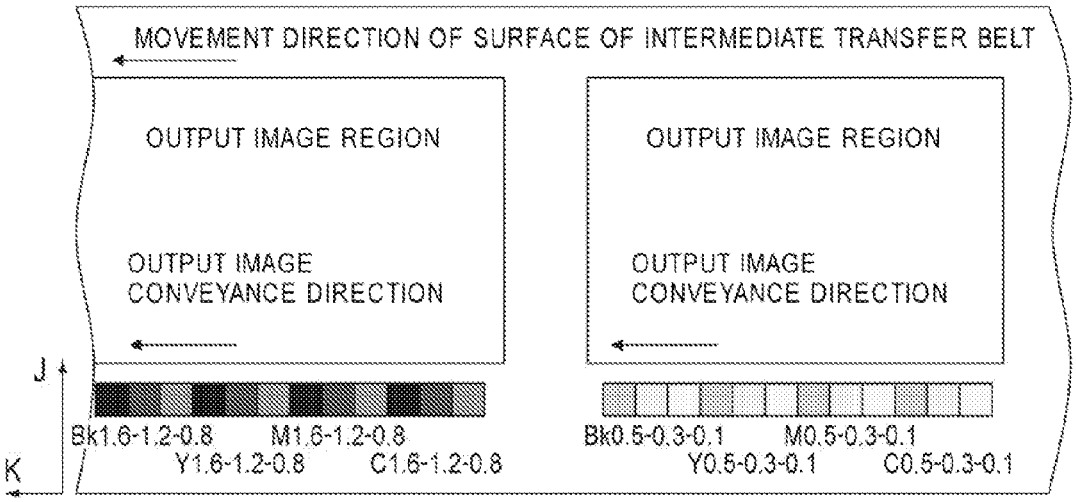
FIG. 7A is a plan view illustrating a case where image control patches are formed on the surface of an intermediate transfer belt when an image forming apparatus is used according to a third embodiment of the invention and FIG. 7B is a graph illustrating a cleaning current flowing in a fur brush with respect to a patch density.

FIG. 7A is a plan view illustrating a case where the image control patches are formed on the surface of an intermediate transfer belt 6 when an image forming apparatus is used according to a third embodiment. Since the configuration of the image forming apparatus according to the third embodiment is the same as that of the image forming apparatus 200 according to the second embodiment, the description of the image forming apparatus will not be repeated. The image forming apparatus according to the third embodiment is different from the image forming apparatus 200 according to the second embodiment in that the shape of the image forming patch transferred to the intermediate transfer belt 6 by the controller is different in the image forming apparatus according to the third embodiment.

As illustrated in FIG. 7A, the shape of one patch has 20 mm in the sub-scanning direction K and 16 mm in the main scanning direction J. A total of six portions are continuously formed in the sub-scanning direction K in the order of "portions of the image control patches Bk with patch densities of 1.6, 1.2, and 0.8" and "portions of the image control patches Y with patch densities of 1.6, 1.2, and 0.8." Further, a total of six portions are continuously formed in the sub-scanning direction K on the upstream side in the order of "portions of the image control patches M with patch densities of 1.6, 1.2, and 0.8" and "portions of the image control patches C with patch densities of 1.6, 1.2, and 0.8." In this way, the twelve portions with the different colors and patch densities are continuously formed in the sub-scanning direction K.

A total of six portions are continuously formed in the sub-scanning direction K in the order of "portions of the image control patches Bk with patch densities of 0.5, 0.3, and 0.1" and "portions of the image control patches Y with patch densities of 0.5, 0.3, and 0.1." Further, a total of six portions are continuously formed in the sub-scanning direction K on the upstream side in the order of "portions of the image control patches M with patch densities of 0.5, 0.3, and 0.1" and "portions of the image control patches C with patch densities of 0.5, 0.3, and 0.1." In this way, the twelve portions with the different colors and patch densities are continuously formed in the sub-scanning direction K.

The gap between the continuously formed patches is set to at least 3 mm. That is, the gap between the "portion of the image control patch C with the patch density of 0.8" and the "portion of the image control patch Bk with the patch density of 0.5" is set to at least 3 mm. In FIG. 7A, the right end of the intermediate transfer belt 6 is cut, and thus the gap is not apparent. In FIG. 7A, it is assumed that the portion of the image control patch Bk with the patch density of 1.6 is present on the right side of the image control patch C. In this case, the gap between the "portion of the image control patch C with the patch density of 0.1" and the "portion of the image control patch Bk with the patch density of 1.6" is set to at least 3 mm. The patch densities are detected and the image control of the toner is performed according to the detection result. Here, the patch densities are values measured by a density measurer (manufactured by X-Rite, Incorporated.) when the patches are transferred to the transfer material P.

Figure 7B:
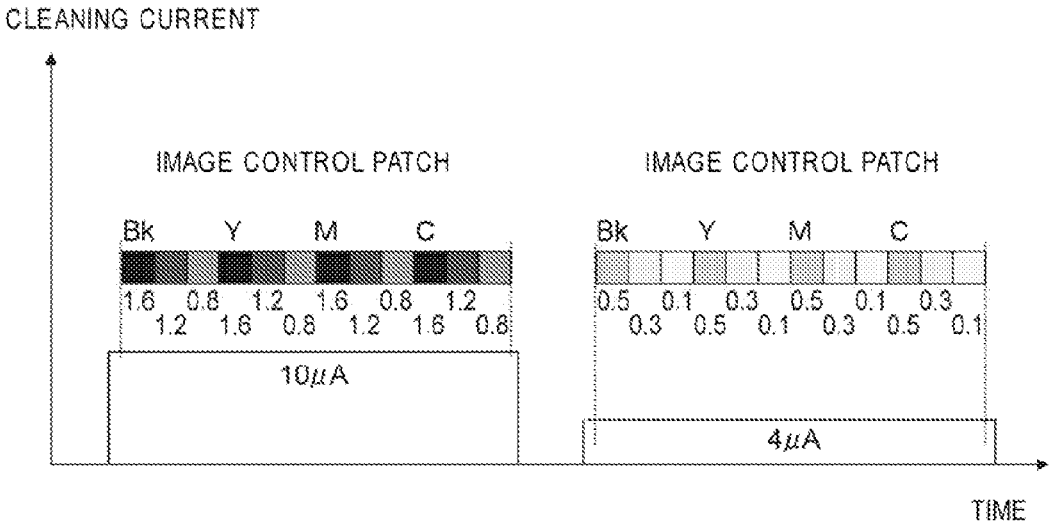

FIG. 7B is a graph illustrating a cleaning current flowing in a fur brush 25 with respect to a patch density. After the patch densities of the image control patches formed on the surfaces of the photosensitive drums 1 are detected by the patch sensor 17, the voltage is applied in synchronization with the passing of the patches attached to the secondary transfer roller 19 through the fur brush 25, the cleaning current flows, and the cleaning current is changed according to the patch densities. As illustrated in FIG. 7B, the cleaning current is controlled with the constant current of +10 μA in the portions of the image control patches with the patch densities of 1.6 (1.4 or more and less than 1.8), 1.2 (1.0 or more and less than 1.4), and 0.8 (0.6 or more and less than 1.0). The cleaning current is controlled with the constant current of +4 μA in the portions of the image control patches with the patch densities of 0.5 (0.4 or more and less than 0.6), 0.3 (0.2 or more and less than 0.4), and 0.1 (0 or more and less than 0.2). Thus, the toner can be collected by the fur brush 25 without excess or deficiency (cleaning failure caused by the deficiency of the cleaning electric field or polarity reversing of the toner caused due to the excess of the cleaning current amount) of the cleaning electric field with respect to the toner charging amount of the patch per unit area. Other high voltage for cleaning flows with a current of about 0.1 μA to about 1.0 μA without ejection of the toner from the fur brush 25.

As a consequence, as in the second embodiment, as illustrated in FIG. 6C, the patches of all the densities can be cleaned from the secondary transfer roller 19 when the method of controlling the cleaning current according to the third embodiment is used. On the other hand, when the method of controlling the fixed cleaning current is used, the patches of all densities are not cleaned from the secondary transfer roller 19. As a consequence, the rear surface of the transfer material P is smeared.

Fourth Embodiment

Figure 8A:
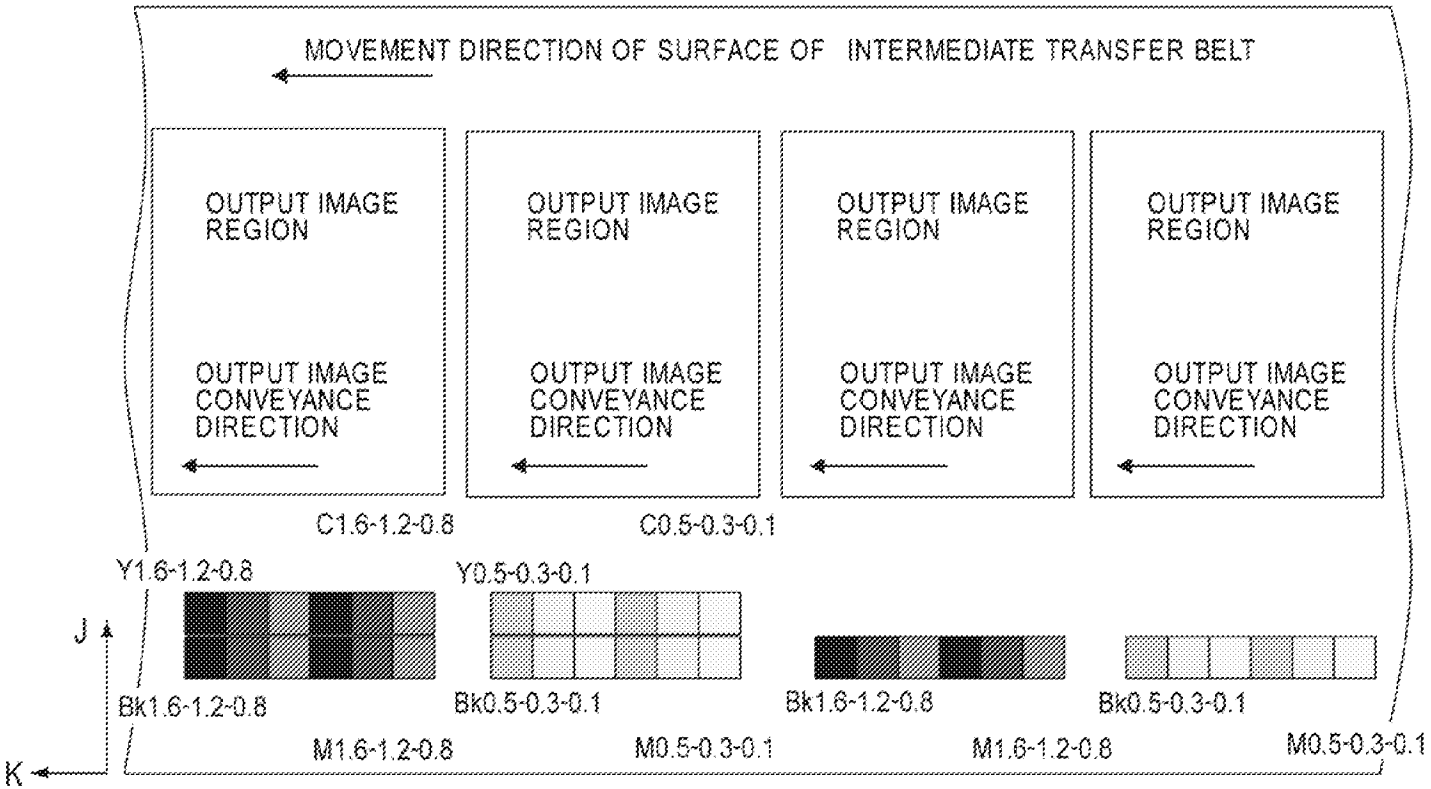
FIG. 8A is a plan view illustrating a case where image control patches are formed on the surface of an intermediate transfer belt when an image forming apparatus is used according to a fourth embodiment of the invention and FIG. 8B is a block diagram illustrating a control system of a controller.

FIG. 8A is a plan view illustrating a case where the image control patches are formed on the surface of an intermediate transfer belt 6 when an image forming apparatus is used according to a fourth embodiment. Since the configuration of the image forming apparatus according to the fourth embodiment is the same as that of the image forming apparatus 200 according to the second embodiment, the description of the image forming apparatus will not be repeated. The image forming apparatus according to the fourth embodiment is different from the image forming apparatus 200 according to the second embodiment in that the shapes of the image control patches transferred to the intermediate transfer belt 6 by the controller 60 are different and the image control patches are formed in two lines in the main scanning direction J in the fourth embodiment.

The controller 60 makes the output value applied to the fur brush 25 according to the number, shape, or size of image control patches in the main scanning direction J. That is, the controller 60 performs the following control according to the number, shape, or size of image control patches formed on the surface of the photosensitive drum 1 or the intermediate transfer belt 6 in the axial direction of the secondary transfer roller 19. That is, the controller 60 changes the cleaning voltage or the cleaning current applied between the secondary transfer roller 19 and the fur brush 25. The patch charge amount of total of the image control patches is different according to the shape of the image control patches, the arrangement number of image control patches in the main scanning direction J, or the size of the image control patches under the control of the controller 60. As a consequence, stable cleaning can be performed.

The controller 60 performs the following control as the number or the size of image control patches formed on the surface of the photosensitive drum 1 or the intermediate transfer belt 6 is large in the axial direction of the secondary transfer roller 19. That is, the controller 60 sets the cleaning voltage or the cleaning current applied between the secondary transfer roller 19 and the fur brush 25 so as to be high. The controller 60 performs the following control as the number or the size of image control patches formed on the surface of the photosensitive drum 1 or the intermediate transfer belt 6 is small in the axial direction of the secondary transfer roller 19. That is, the controller 60 sets the cleaning voltage or the cleaning current applied between the secondary transfer roller 19 and the fur brush 25 so as to be low.

As illustrated in FIG. 8A, the shape of one patch has 20 mm in the sub-scanning direction K and 16 mm in the main scanning direction J. A total of six portions are continuously formed in the sub-scanning direction K in the order of "portions of the image control patches Bk with patch densities of 1.6, 1.2, and 0.8" and "portions of the image control patches M with patch densities of 1.6, 1.2, and 0.8." Further, a total of six portions are continuously formed in the sub-scanning direction K in the order of "portions of the image control patches Y with patch densities of 1.6, 1.2, and 0.8" and "portions of the image control patches C with patch densities of 1.6, 1.2, and 0.8." In this way, the every six portions are continuously formed in parallel in the main scanning direction J.

Likewise, a total of six portions are continuously formed in the sub-scanning direction K on the upstream side in the order of "portions of the image control patches Bk with patch densities of 0.5, 0.3, and 0.1" and "portions of the image control patches M with patch densities of 0.5, 0.3, and 0.1." Further, a total of six portions are continuously formed in the sub-scanning direction K in the order of "portions of the image control patches Y with patch densities of 0.5, 0.3, and 0.1" and "portions of the image control patches C with patch densities of 0.5, 0.3, and 0.1." In this way, the every six portions are continuously formed in parallel in the main scanning direction J.

On the upstream side of the above-described full four-color image, the image control patches are not arranged in parallel in the main scanning direction J, as described above, and the following control is performed, for example, when the Y and C toner images are not used in a case of a job in which two color images are mixed. That is, as illustrated in FIG. 8A, a total of six image control patches are continuously formed in the sub-scanning direction K in the order of the portions of the image control patches Bk with the patch densities of 1.6, 1.2, and 0.8 and the portions of the image control patches M with the patch densities of 1.6, 1.2, and 0.8. Likewise, a total of six image control patches are continuously formed in the sub-scanning direction K in the order of the portions of the image control patches Bk with the patch densities of 0.5, 0.3, and 0.1 and the portions of the image control patches M with the patch densities of 0.5, 0.3, and 0.1.

The gap between the continuously formed patches is set to at least 3 mm. That is, the gap between the "portions of the image control patches C and M with the patch density of 0.8" and the "portions of the image control patches Y and Bk with the patch density of 0.5" is set to at least 3 mm. The gap between the "portion of the image control patch M with the patch density of 0.1" and the "portion of the image control patch Bk with the patch density of 1.6" is set to at least 3 mm. The gap between the "portion of the image control patch M with the patch density of 0.8" and the "portion of the image control patch Bk with the patch density of 0.5" is set to at least 3 mm. In FIG. 8A, the right end of the intermediate transfer belt 6 is cut, and thus the gap is not apparent. It is assumed that the "portions of the image control patches Y and Bk with the patch density of 1.6 in the second line in the main scanning direction J" is present at the first positions on the downstream side on the right side of the "portion of the image control patch M with the patch density of 0.1 in the fourth image control patches of the first line from the downstream side." In this case, the gap between the "portion of the image control patch M with the patch density of 0.1" and the "portion of the image control patch Bk with the patch density of 1.6" is set to at least 3 mm. The patch densities are detected and the image control of the toner is performed according to the detection result. Here, the patch densities are values measured by a density measurer (manufactured by X-Rite, Incorporated.) when the patches are transferred to the transfer material P.

Figure 8B:
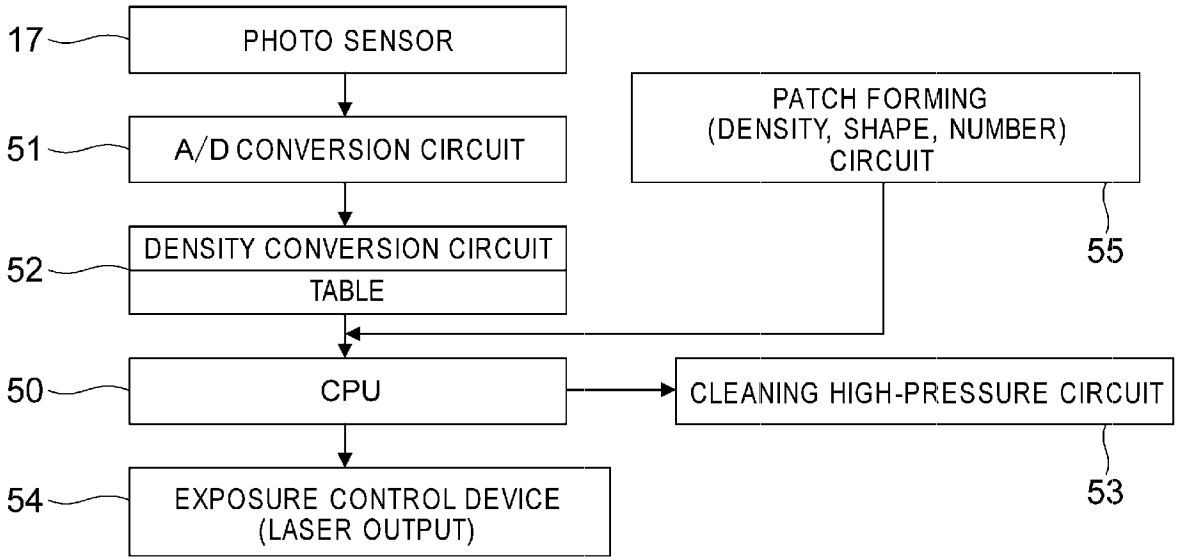

FIG. 8B is a block diagram illustrating a control system of the controller 60. As illustrated in FIG. 8B, the controller 60 allows the cleaning high-pressure circuit 53 to adjust the cleaning current based on information regarding the toner densities, the toner shape, and the toner number received from the patch forming circuit 55. The patch sensor 17 detects the patch densities of the image control patches formed on the photosensitive drums 1Y to 1*k*. Then, the voltage is applied in synchronization with the passing of the image control patches attached to the secondary transfer roller 19 through the fur brush 25 so that the cleaning current flows. Further, the cleaning current is changed according to the patch densities.

Figure 9A:
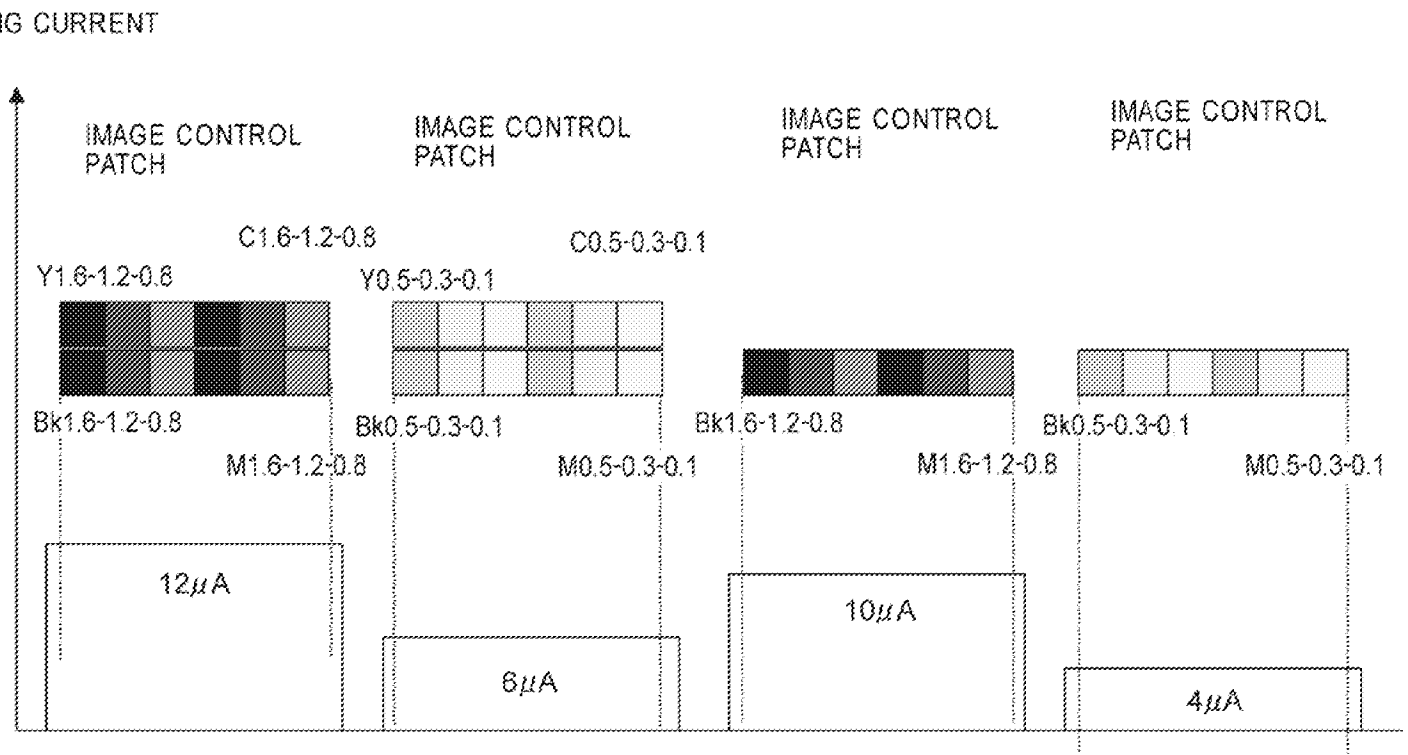

FIG. 9A is a graph illustrating a correspondence relationship between the densities of the image control patches and the cleaning current. As illustrated in FIG. 9A, when two image control patches are continuously formed in parallel in the main scanning direction J, the cleaning current is controlled with the constant current of +12 μA in the image control patches with the patch densities of 1.6 (1.4 or more and less than 1.8), 1.2 (1.0 or more and less than 1.4), and 0.8 (0.6 or more and less than 1.0). The cleaning current is controlled with the constant current of +6 μA in the image control patches with the patch densities of 0.5 (0.4 or more and less than 0.6), 0.3 (0.2 or more and less than 0.4), and 0.1 (0 or more and less than 0.2). When only one image control patch is present in the main scanning direction J, the cleaning current is controlled with the constant current of +10 μA in the image control patch with the patch densities of 1.6 (1.4 or more and less than 1.8), 1.2 (1.0 or more and less than 1.4), or 0.8 (0.6 or more and less than 1.0). The cleaning current is controlled with the constant current of +4 μA in the image control patch with the patch densities of 0.5 (0.4 or more and less than 0.6), 0.3 (0.2 or more and less than 0.4), or 0.1 (0 or more and less than 0.2). Thus, the toner can be collected by the fur brush 25 without excess or deficiency (cleaning failure caused by the deficiency of the cleaning electric field or polarity reversing of the toner caused due to the excess of the cleaning current amount) of the cleaning electric field with respect to the toner charging amount of the patch per unit area. Other high voltage for cleaning flows with a current of about 0.1 μA to about 1.0 μA without ejection of the toner from the fur brush.

FIGS. 9B and 9C are tables illustrating a state where the rear surface of the transfer material P is smeared. In FIGS. 9B and 9C, "good" indicates a case where it is determined that there is no rear sheet smear and "no good" indicates a case where it is determined that there is rear sheet smear. As illustrated in FIGS. 9B and 9C, two patches of all the densities arranged in the main scanning direction J and one patch of all the densities can be cleaned from the secondary transfer roller 19 when the method of controlling the cleaning current according to the fourth embodiment is used. On the other hand, when the method of controlling the fixed cleaning current is used, the patches of all densities are not cleaned from the secondary transfer roller 19. As a consequence, the rear surface of the transfer material P is smeared.

That is, in the fourth embodiment, the controller 60 changes the cleaning current by the output applied to the bias roller 26 by the bias applying device 30 according to the densities of the image control patches detected by the patch sensor 17. In particular, the magnitude of the cleaning current is made different between the image control patches arranged in two lines in the main scanning direction J and the image control patches arranged in only one line in the main scanning direction J. Thus, the toner of all the patch densities is collected.

On the other hand, it is focused on the row of the fixed +10 μA and +4 μA in FIG. 9B. Here, the cleaning current is set to +10 μA in the portions with the patch densities of 1.6 (1.4 or more and less than 1.8), 1.2 (1.0 or more and less than 1.4), and 0.8 (0.6 or more and less than 1.0), irrespective of cases where two image control patches are arranged and one image control patch is arranged in the main scanning direction J. Further, the cleaning current is set to +4 μA in the portions with the patch densities of 0.5 (0.4 or more and less than 0.6), 0.3 (0.2 or more and less than 0.4), and 0.1 (0 or more and less than 0.2). Then, a rear sheet smear occurs in the portion with the patch densities 1.6 (1.4 or more and less than 1.8) and 0.5 (0.4 or more and less than 0.6). This is because where the number of patches in the main scanning direction J increases, the charge amount of image control patches to be cleaned increases. In this embodiment, in order to stabilize the cleaning capability, the cleaning current is controlled according to the number of patches in the main scanning direction J, and eventually, the shape (entire shape) of the image control patches.

The experiment results of "good" and "no good" can be obtained in regard to the other rows of FIGS. 9B and 9C, as described in the first to third embodiments.

Fifth Embodiment

FIG. 10A is a graph illustrating a correspondence relationship between the densities of the image control patches and the cleaning current when an image forming apparatus is used according to a fifth embodiment. Since the configuration of the image forming apparatus according to the fifth embodiment is the same as that of the image forming apparatus 200 according to the second embodiment, the description of the image forming apparatus will not be repeated. The image forming apparatus according to the fifth embodiment is different from the image forming apparatus 200 according to the second embodiment in that the shape of the image control patches transferred to the intermediate transfer belt 6 by the controller 60 is different and the image control patches are separated into four lines in the main scanning direction J in the image forming apparatus according to the fifth embodiment. Further, the image control patches are formed between the output image regions in the sub-scanning direction K.

As illustrated in FIG. 10A, the shape of one patch has 20 mm in the sub-scanning direction K and 16 mm in the main scanning direction J. Each one of the patches with the color patch densities of 1.6, 1.2, 0.8, 0.5, 0.3, and 0.1 is formed between the output image regions at the position corresponding to the space between the transfer materials P. The patch densities are detected and the image control of the toner is performed according to the detection result. Here, the patch densities are values measured by a density measurer (manufactured by X-Rite, Incorporated.) when the patch is transferred to the transfer material P. In FIGS. 10A to 10C, the image control patches are arranged in the order of Bk, Y, M, and C from the upper side to the lower side.

FIG. 10B is a graph illustrating a correspondence relationship between the densities of the image control patches and the cleaning current. As illustrated in FIG. 10B, after the patch densities of the image control patches formed on the photosensitive drums 1 are detected by the patch sensor 17, the voltage is applied in synchronization with the passing of the patches attached to the secondary transfer roller 19 through the fur brush 25, the cleaning current flows, and the cleaning current is changed according to the patch densities. Here, four image control patches are arranged in parallel in the main scanning direction J. The cleaning current is controlled with the constant current of +13 μA in the portions of the image control patches with the patch densities of 1.6 (1.4 or more and less than 1.8), 1.2 (1.0 or more and less than 1.4), and 0.8 (0.6 or more and less than 1.0). The cleaning current is controlled with the constant current of +7 μA in the portions of the image control patches with the patch densities of 0.5 (0.4 or more and less than 0.6), 0.3 (0.2 or more and less than 0.4), and 0.1 (0 or more and less than 0.2). Thus, the toner can be collected by the fur brush 25 without excess or deficiency (cleaning failure caused by the deficiency of the cleaning electric field or polarity reversing of the toner caused due to the excess of the cleaning current amount) of the cleaning electric field with respect to the toner charging amount of the patch per unit area. Other high voltage for cleaning flows with a current of about 0.1 μA to about 1.0 μA without ejection of the toner from the fur brush 25.

FIG. 10C is a table illustrating a state where the rear surface of the transfer material P is smeared. In FIG. 10C, "good" indicates a case where it is determined that there is no rear sheet smear and "no good" indicates a case where it is determined that there is rear sheet smear. As illustrated in FIG. 10C, the patches of all the densities can be cleaned from the secondary transfer roller 19 when the method of controlling the cleaning current according to the fifth embodiment is used. On the other hand, when the method of controlling the fixed cleaning current is used, the patches of all densities are not cleaned from the secondary transfer roller 19. As a consequence, the rear surface of the transfer material P is smeared.

According to the configuration described in the first to fifth embodiments, the following advantages can be obtained. That is, it is assumed that the image control toner images with a wide range of density gray scales are formed in the image control regions near the image formation regions on the photosensitive drum or the intermediate transfer belt. In this case, it is possible to improve the cleaning property of the toner of the image control toner images transferred to the transfer roller 9 and the secondary transfer roller 19 from the photosensitive drum or the intermediate transfer belt by the fur brush 25.

In the above-described configurations, the patch sensor 17 detects the densities of the image control patches. However, the invention is not limited to the configuration in which the densities of the image control patches are detected. For example, the cleaning current may be changed by the output applied to the bias roller 26 by the bias applying device 30 based on the image signal used to form the image control patches.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-228678, filed Oct. 8, 2010, which is hereby incorporated by reference herein in its entirety.

What is claimed is:

1. An image forming apparatus comprising:

an image bearing member that is rotatable;

a toner image forming portion that is able to form a toner image to be transferred to a transfer material and a control toner image not to be transferred to a transfer material on the image bearing member;

a transfer member that transfers the toner image formed on the image bearing member to the transfer material;

a detecting portion that detects a density of the control toner image;

an adjustment portion that adjusts a toner image formation condition of the toner image forming portion based on an output of the detecting portion;

a cleaning member that electrostatically cleans the transfer member; and a controller which changes a voltage or a current to be applied between the transfer member and the cleaning member based on the density of the control toner image, wherein when a previous control toner image and a subsequent control toner image adjacent to each other with a predetermined gap in a movement direction of the image bearing member are present on the surface of the image bearing member, the larger a density difference between the previous control toner image and the subsequent control toner image becomes, the larger the controller sets the predetermined gap.

2. The image forming apparatus according to claim 1, wherein the toner image is formed in a region near the control toner image in a direction perpendicular to a rotation direction of the image bearing member and is transferred to the transfer material by the transfer member of which an end portion is located outside the region.

3. The image forming apparatus according to claim 1, wherein the toner image is formed in a region near the control toner image in a rotation direction of the image bearing member and is transferred to the transfer material by the transfer member.

4. The image forming apparatus according to claim 1, wherein the higher the density of the control toner image becomes, the larger the controller sets an absolute value of the voltage or the current, whereas the lower the density of the control toner image becomes, the smaller the controller sets an absolute value of the voltage or the current.

5. The image forming apparatus according to claim 1, wherein the controller changes the voltage or the current for each density of a predetermined range when the control toner image has a plurality of densities.

6. The image forming apparatus according to claim 1, wherein the controller changes the voltage or the current based on the number, shapes, or sizes of control toner images formed on the surface of the image bearing member in an axial direction of the transfer member.

7. The image forming apparatus according to claim 6, wherein the larger the number or sizes of control toner images formed on the image bearing member in the axial direction of the transfer member becomes, the larger the controller sets an absolute value of the voltage or the current, whereas the smaller the number or sizes of control toner images formed on the image bearing member in the axial direction of the transfer member becomes, the smaller the controller sets an absolute value of the voltage or the current.

8. The image forming apparatus according to claim 1, wherein the image bearing member includes a photosensitive drum or an intermediate transfer belt.

9. The image forming apparatus according to claim 1, wherein the cleaning member includes a fur brush and faces the transfer member, a rotation direction of the fur brush is the same as a rotation direction of the transfer member.

* * * * *